US009515429B2

(12) United States Patent
De Geest et al.

(10) Patent No.: US 9,515,429 B2
(45) Date of Patent: Dec. 6, 2016

(54) HIGH SPEED ELECTRICAL CONNECTOR

(71) Applicant: FCI Asia Pte. Ltd., KA Place (SG)

(72) Inventors: Jan De Geest, Wetteren (BE); Stefaan Hendrik Jozef Sercu, Wuustwezel (BE); Johannes Maria Blasius van Woensel, Rosmalen (NL)

(73) Assignee: FCI Asia Pte. Ltd., KA Place (SG)

( * ) Notice: Subject to any disclaimer, the term of this patent is extended or adjusted under 35 U.S.C. 154(b) by 174 days.

(21) Appl. No.: 13/972,236

(22) Filed: Aug. 21, 2013

(65) Prior Publication Data

US 2014/0057493 A1 Feb. 27, 2014

Related U.S. Application Data

(60) Provisional application No. 61/693,766, filed on Aug. 27, 2012.

(51) Int. Cl.

| | |
|---|---|
| ***H01R 13/648*** | (2006.01) |
| ***H01R 24/00*** | (2011.01) |
| ***H01R 12/72*** | (2011.01) |
| ***H01R 13/6594*** | (2011.01) |
| ***H01R 13/6585*** | (2011.01) |
| ***H01R 13/6471*** | (2011.01) |

(Continued)

(52) U.S. Cl.

CPC ..... *H01R 23/005* (2013.01); *H01R 12/724* (2013.01); *H01R 12/737* (2013.01); *H01R 13/6471* (2013.01); *H01R 13/6585* (2013.01); *H01R 13/6594* (2013.01); *H01R 12/585* (2013.01); *H01R 13/6597* (2013.01)

(58) Field of Classification Search

CPC ..... H01R 23/688; H01R 23/7073; H01R 13/65807

USPC ..... 439/607.35, 607.05, 607.06, 607.07,439/607.08, 607.09

See application file for complete search history.

(56) References Cited

U.S. PATENT DOCUMENTS 6,146,157 A * 11/2000 Lenoir ..... H01R 23/688 439/101

6,347,962 B1 2/2002 Kline (Continued)

FOREIGN PATENT DOCUMENTS

| | | |
|---|---|---|
| FR | 2783361 | 3/2000 |
| WO | WO 2008/156852 | 12/2008 |
| WO | WO 2013/056066 | 4/2013 |

OTHER PUBLICATIONS

Extended European Search Report for EP Application No. 13833742.3 dated Sep. 21, 2016.

*Primary Examiner* — Hae Moon Hyeon

(74) *Attorney, Agent, or Firm* — Wolf, Greenfield & Sacks, P.C.

(57) ABSTRACT

An electrical connector assembly includes a first electrical connector and a second electrical connector. Each electrical connector can include a plurality of electrical ground shields that at least partially surround respective differential signal pairs. The electrical connectors can be constructed so as to reduce cross-talk between adjacent signal pairs. For example, the first electrical connector can include a connector housing defining an end that is configured to be mounted to a substrate. The ground shields can define a body that extends through the connector housing, such that the ground shields extend through the end so as to be disposed between the end and the substrate when the connector is mounted to the substrate.

31 Claims, 22 Drawing Sheets

(51) Int. Cl.

| | |
|---|---|
| ***H01R 12/73*** | (2011.01) |
| *H01R 13/6597* | (2011.01) |
| *H01R 12/58* | (2011.01) |

(56) References Cited

U.S. PATENT DOCUMENTS

| | | | | |
|---|---|---|---|---|
| 6,409,543 | B1 | 6/2002 | Astbury, Jr. et al. | |
| 6,833,513 | B1 | 12/2004 | Ahmad | |
| 6,899,566 | B2 | 5/2005 | Kline et al. | |
| 7,182,643 | B2 | 2/2007 | Winings et al. | |
| 7,794,278 | B2 * | 9/2010 | Cohen | H01R 13/65807 439/108 |
| 7,819,697 | B2 | 10/2010 | Glover et al. | |
| 7,862,344 | B2 * | 1/2011 | Morgan et al. | 439/67 |
| 7,901,248 | B2 * | 3/2011 | Lappoehn | 439/607.05 |
| 7,976,318 | B2 | 7/2011 | Fedder et al. | |
| 8,080,738 | B2 | 12/2011 | Morgan | |
| 8,371,876 | B2 * | 2/2013 | Davis | 439/607.07 |
| 8,382,522 | B2 | 2/2013 | Glover et al. | |
| 8,398,432 | B1 * | 3/2013 | McClellan | H01R 13/6587 439/607.07 |
| 8,430,691 | B2 * | 4/2013 | Davis | H01R 13/6585 439/607.09 |
| 8,641,448 | B2 * | 2/2014 | Lappoehn | 439/607.09 |
| 8,870,594 | B2 * | 10/2014 | McClellan et al. | 439/607.05 |
| 8,905,785 | B2 * | 12/2014 | Johnescu | H01R 13/65807 439/607.03 |
| 2005/0196987 | A1 | 9/2005 | Shuey et al. | |
| 2010/0144175 | A1 | 6/2010 | Helster et al. | |
| 2010/0227503 | A1 | 9/2010 | Liu et al. | |
| 2011/0143591 | A1 | 6/2011 | Davis et al. | |
| 2011/0212650 | A1 | 9/2011 | Amleshi et al. | |
| 2011/0269343 | A1 | 11/2011 | Chen | |
| 2012/0129394 | A1 | 5/2012 | Davis et al. | |
| 2012/0202380 | A1 * | 8/2012 | Lappoehn | H01R 23/688 439/607.09 |
| 2013/0017723 | A1 | 1/2013 | Davis et al. | |
| 2015/0056868 | A1 | 2/2015 | Goossens | |

* cited by examiner

HIGH SPEED ELECTRICAL CONNECTOR

CROSS REFERENCE TO RELATED APPLICATIONS

This application claims the benefit of U.S. Provisional Patent Application Ser. No. 61/693,766 filed Aug. 27, 2012, the disclosure of which is hereby incorporated by reference as if set forth in its entirety herein.

TECHNICAL FIELD

The present disclosure relates generally to the field of electrical connectors, and in particular relates to an electrical connector that is configured to reduce cross-talk between adjacent signal contacts.

BACKGROUND

Electrical connectors provide signal connections between electronic devices using electrically-conductive contacts, or electrical contacts. In some applications, an electrical connector provides a connectable interface between one or more substrates, e.g., printed circuit boards. Such an electrical connector may include a receptacle connector mounted to a first substrate and a complementary header connector mounted to a second substrate. Typically, a first plurality of electrical receptacle contacts in the receptacle connector is adapted to mate with a corresponding plurality of electrical header contacts in the header connector. For instance, the electrical receptacle contacts can receive the electrical header contacts so as to establish an electrical connection between the electrical receptacle contacts and the electrical header contacts. One example of a conventional connector is set forth in U.S. Pat. No. 7,182,643, which is incorporated by reference as if set forth in its entirety herein.

SUMMARY

In accordance with one embodiment, an electrical connector is configured to be mounted onto a substrate. The electrical connector includes a connector housing defining an end that is configured to be mounted to the substrate, a plurality of electrical signal contacts supported by the connector housing, and a plurality of ground shields supported by the connector housing, the ground shields at least partially surround respective ones of the electrical signal contacts.

DETAILED DESCRIPTION

Figure 1:
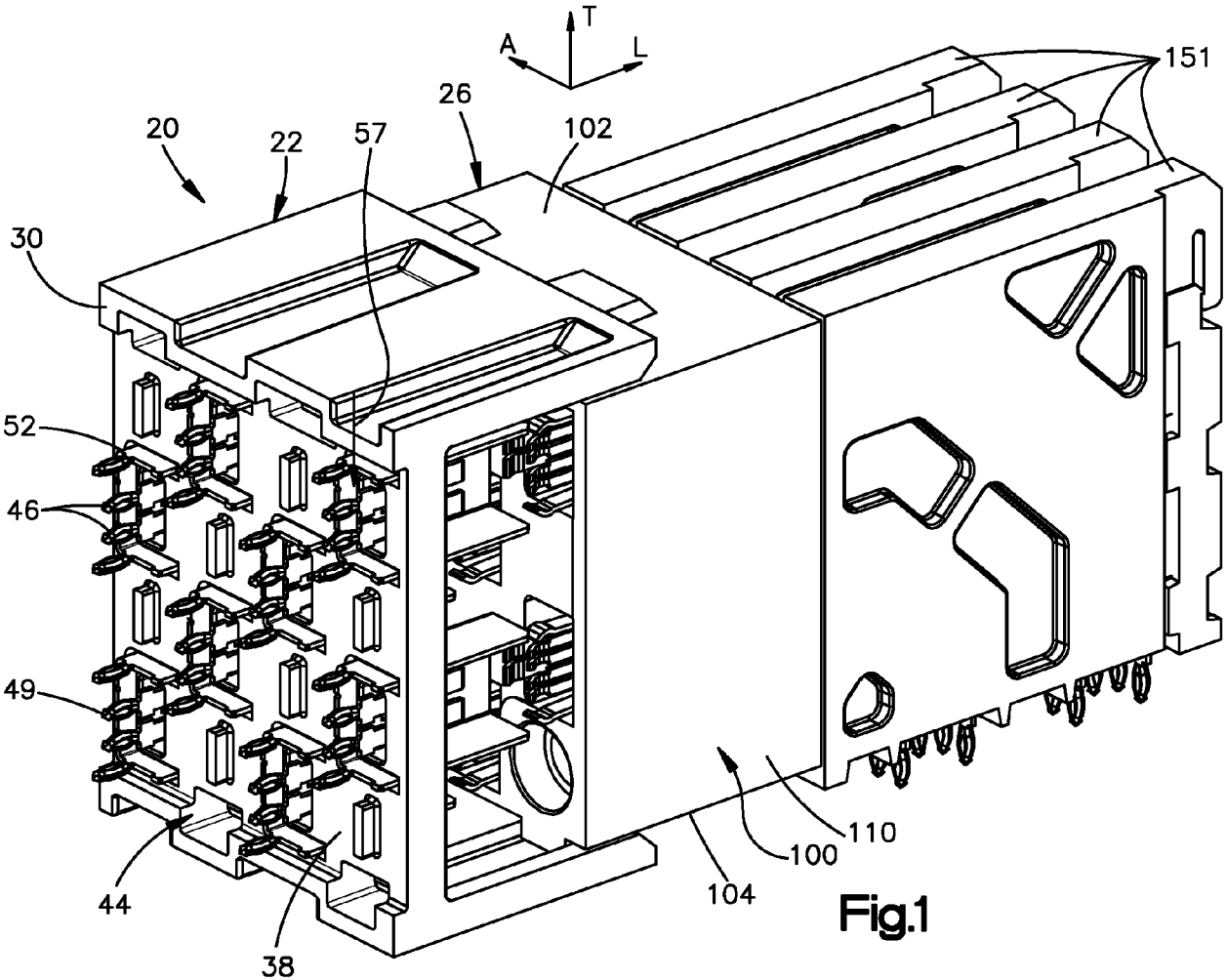
FIG. 1 is a perspective view of an electrical connector assembly constructed in accordance with one embodiment including an electrical header connector and an electrical receptacle connector configured to be mated to each other and electrically connected to first and second respective substrates.
Figure 3B:
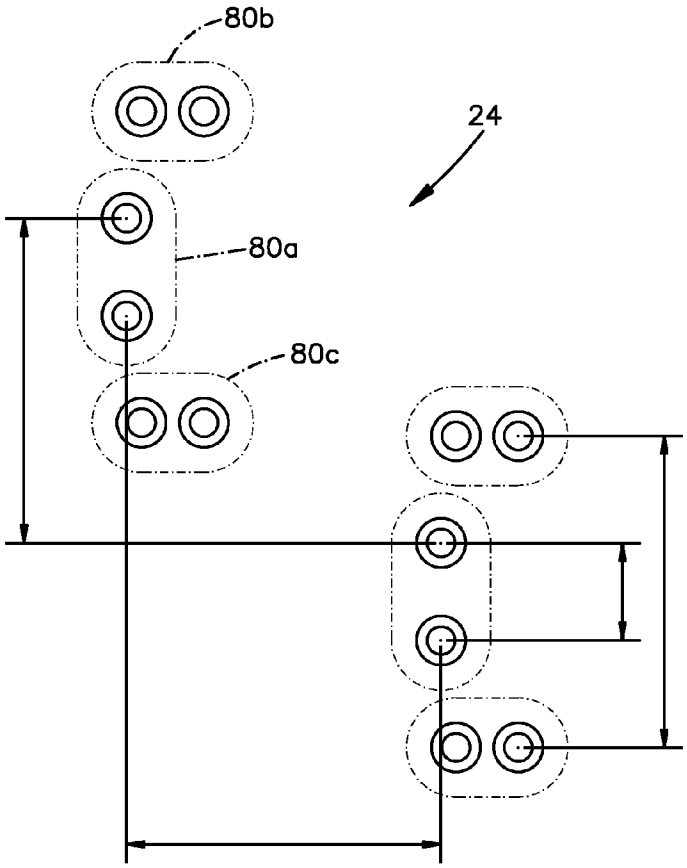
FIG. 3B is an exploded top plan view of a portion of the first substrate illustrated in FIG. 3A.
Figure 3A:
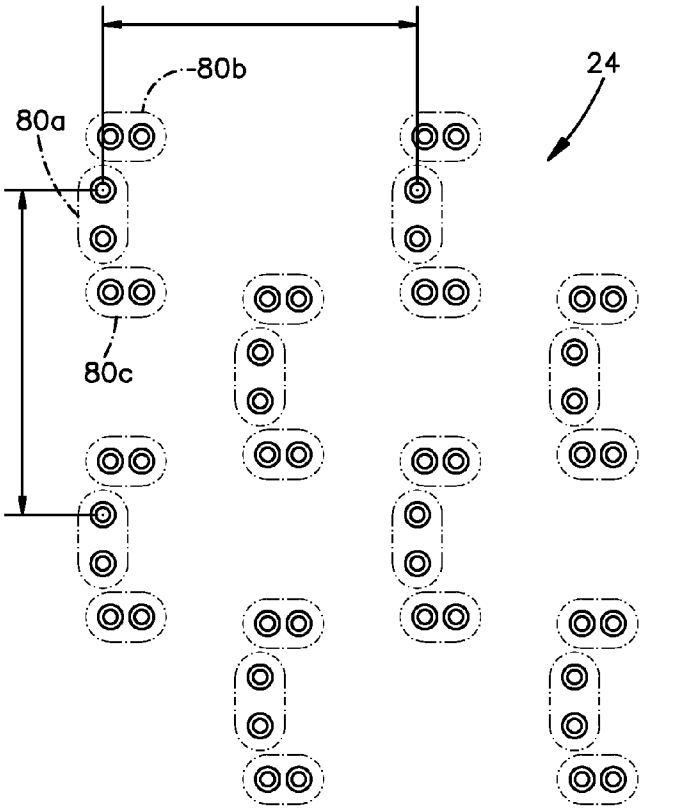
FIG. 3A is a top plan view of a first substrate to which the electrical header connector illustrated in FIG. 2A is configured to be mounted, the top plan view showing a footprint of the first substrate.
Figure 3D:
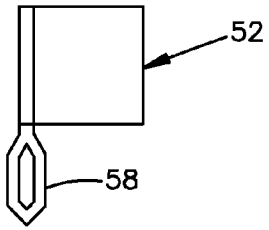
FIG. 3D is a schematic side elevation view of a mounting portion of the electrical ground shield illustrated in FIG. 2A, the mounting portion configured to be mounted to the first substrate illustrated in FIG. 3A.

Referring to FIG. 1, an electrical connector assembly 20 includes a first electrical connector 22 configured to be electrically connected to a first substrate 24 (see FIGS. 3A-B) which can be provided as a printed circuit board (PCB), and a second electrical connector 26 configured to be electrically connected to a second substrate 28 (see FIGS. 5A-B), such as a PCB. The first substrate 24 can be configured as a backpanel, and the second substrate 28 can be configured as a daughtercard. The first and second electrical connectors 22 and 26 are configured to mate with each other so as to place the first and second substrates 24 and 28 in electrical communication with each other.

Figure 2A:
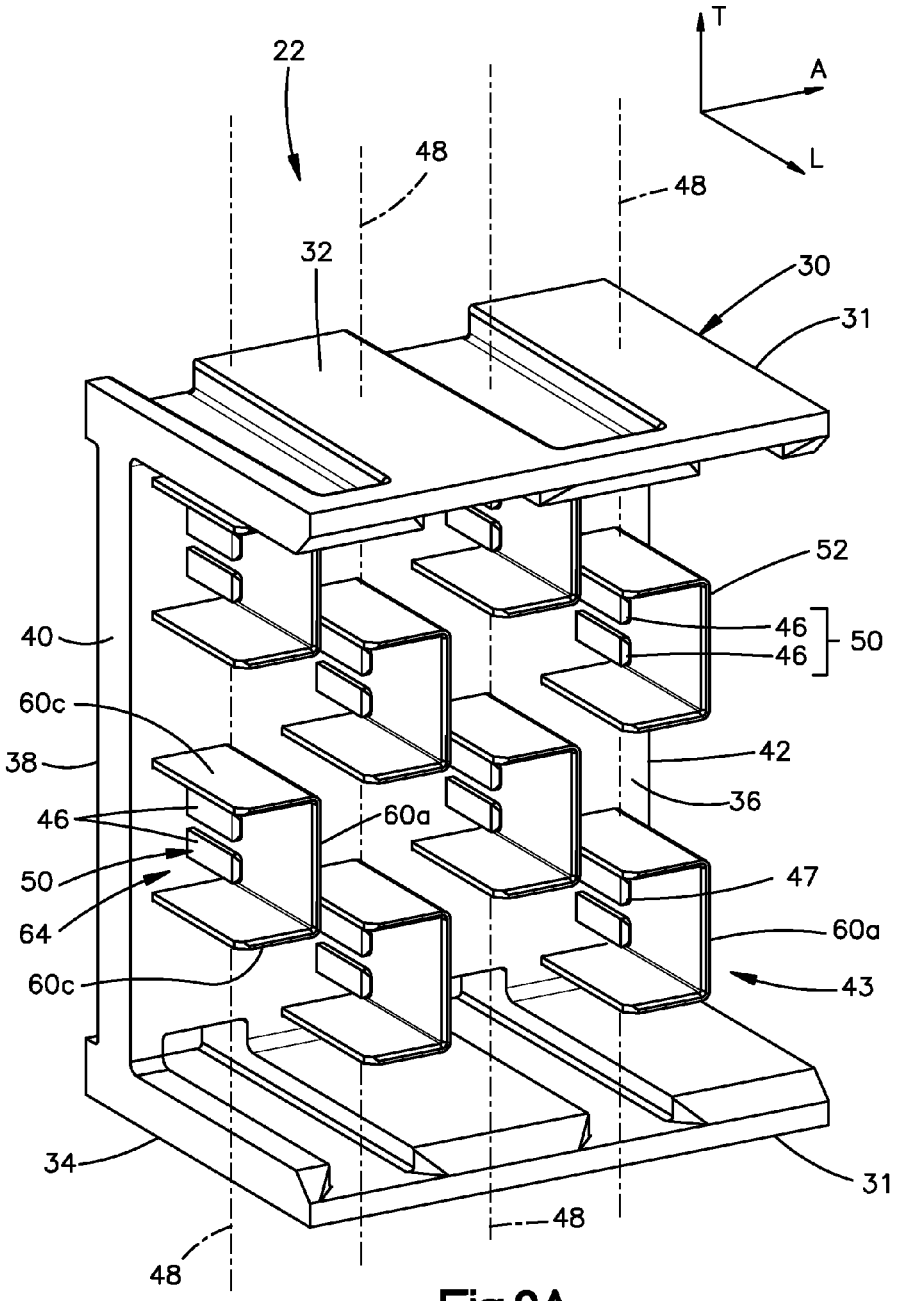
FIG. 2A is a perspective view of the electrical header connector illustrated in FIG. 1, including a housing, and a plurality of electrical signal contacts and electrical ground shields supported by the housing.
Figure 2C:
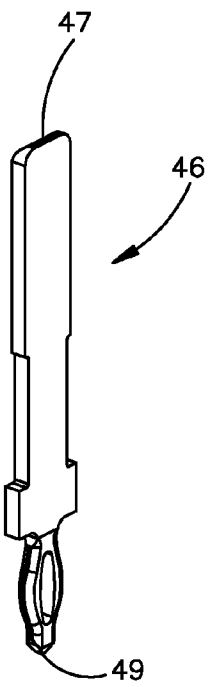
FIG. 2C is a perspective view of one of the electrical signal contacts of the electrical header connector illustrated in FIG. 2A.
Figure 2B:
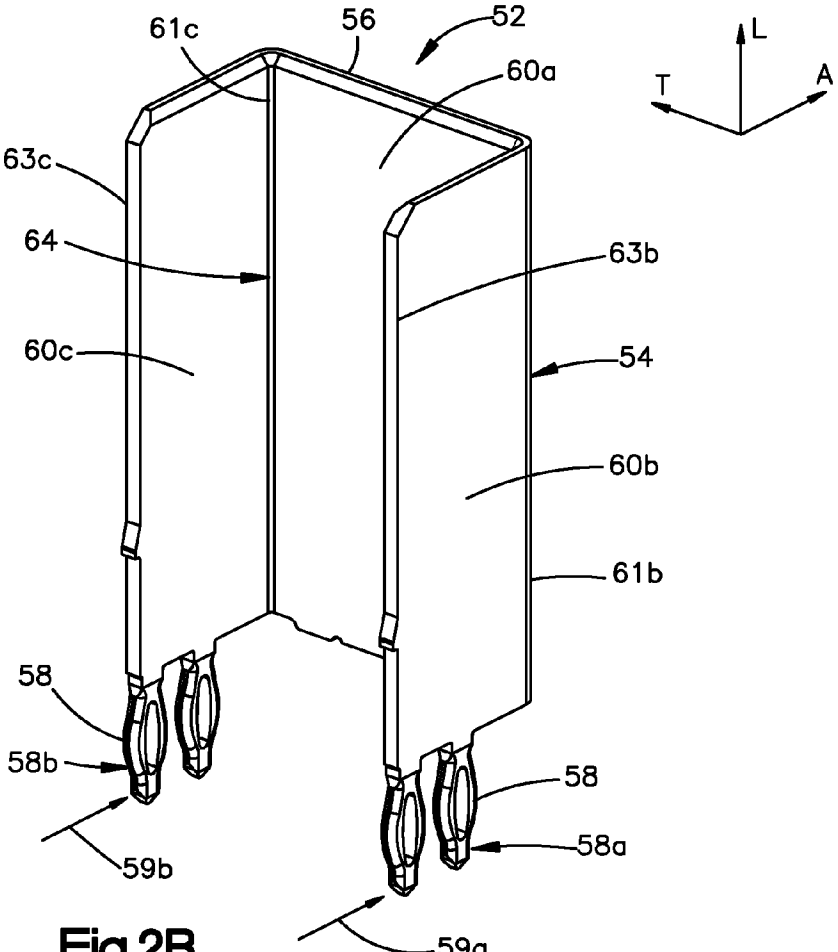
FIG. 2B is a perspective view of one of the ground shields of the electrical header connector illustrated in FIG. 2A.
Figure 2E:
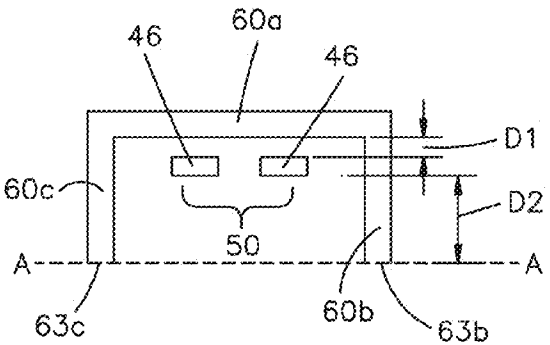
FIG. 2E is a schematic front elevation view as illustrated in FIG. 2D.
Figure 2D:
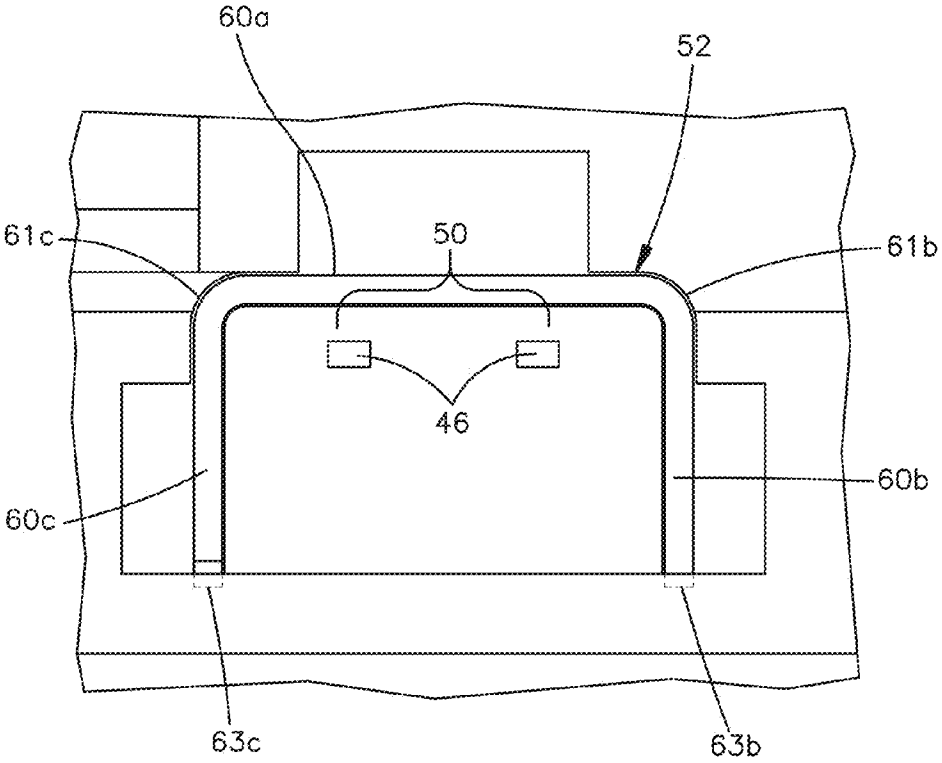
FIG. 2D is a front elevation view of a portion of the electrical header connector illustrated in FIG. 2A, showing the ground shield illustrated in FIG. 2B and a pair of the electrical signal contacts illustrated in FIG. 2C defining a differential signal pair.

Referring also to FIG. 2A-C, the first electrical connector 22 includes a connector housing 30 that is dielectric or electrically insulative, and defines a top end 32, an opposed bottom end 34 spaced from the top end 32 along a transverse direction T, a front end 36 and an opposed rear end 38 that is spaced from the front end 36 along a longitudinal direction L that is substantially perpendicular to the transverse direction T, and first and second opposed sides 40 and 42, respectively, that are spaced from each other along a lateral direction A that is substantially perpendicular to the transverse direction T and the longitudinal direction L. In accordance with the illustrated embodiment, the transverse direction T is oriented vertically, and the longitudinal and lateral directions L and A are oriented horizontally, though it should be appreciated that the orientation of the connector housing 30 may vary during use. In accordance with the illustrated embodiment, the first electrical connector 22 is configured to be mated to the second electrical connector 26 along the longitudinal direction L, which can thus define a mating direction from the rear end 38 to the front end 36. The first electrical connector 22 can further include guidance arms 31 that extend forward from the front end 36 along the longitudinal direction L. The front end 36 is configured to face the housing of the second electrical connector 26 along the longitudinal direction L when the first and second electrical connectors 22 and 26 are mated. For instance, the front end 36 can be configured to abut the second electrical connector 26.

The connector housing 30 thus defines a mating interface 43 disposed proximate to the front end 36 and a mounting interface 44 disposed proximate to the rear end 38. The mounting interface 44 is configured to operatively engage the first substrate 24, while the mating interface 43 is configured to operatively engage the second electrical connector 26. The first electrical connector 22 includes a plurality of electrical signal contacts 46 that are electrically conductive and supported by the connector housing 30, and a plurality of electrical ground shields 52 that are electrically conductive (and can be metallic) and supported by the connector housing 30 such that at least one or more up to all of the electrical ground shields 52 at least partially surrounds one or more of the electrical signal contacts 46. The ground shields 52 can be electrically isolated from each other in the first electrical connector 22, and in particular by the electrically nonconductive connector housing 30. Each of the electrical signal contacts 46 defines a mating end 47 disposed proximate to the mating interface 43, and an opposed mounting end 49 disposed proximate to the mounting interface 44. For instance, the mounting ends 49 can be configured as eye-of-the-needle press-fit tails that can be press-fit into complementary apertures or vias that extend into or through the first substrates 24. Alternatively, the mounting ends 49 can be configured to be surface mounted to the first substrates 24. In accordance with the illustrated embodiment, the mating interface 43 of the connector housing 30 is oriented substantially parallel with respect to the mounting interface 44, and the mating ends 47 of the electrical contacts 46 are substantially parallel with respect to the mounting ends 49 along the longitudinal direction L. Thus, the first electrical connector 22 can be referred to as a vertical connector, and the electrical signal contacts 46 can be referred to as vertical electrical contacts. Further, the mating ends 47 can be configured as blades that are received by corresponding mating ends of the electrical signal contacts of the second electrical connector 26, and the first electrical connector 22 can be referred to as a header connector. Alternatively, the electrical connector 22 can be configured as a right-angle connector whereby the mating interface is oriented substantially perpendicular with respect to the mounting interface, and the electrical signal contacts 46 can be configured as right-angle electrical contacts whereby the mating ends 47 are oriented substantially perpendicular with respect to the mounting ends 49. Similarly, the first electrical connector 22 can be configured as a receptacle connector, whereby the mating ends 47 are configured to receive the mating ends of the electrical contacts of the second electrical connector 26.

The electrical signal contacts 46 can be arranged along a plurality of parallel column centerlines 48 that extend along the transverse direction T, which defines a column direction, such that adjacent electrical signal contacts 46 are edge-coupled (wherein the edges of the electrical signal contacts 46 that define a differential signal pair 50 face each other) along the respective centerlines so as to define differential signal pairs 50. The differential signal pairs 50 of each centerline 48 can be offset with respect to all of the differential signal pairs 50 of respective adjacent centerlines 48 such that none of the electrical signal contacts 46 of each differential signal pair 50 of one centerline 48 are aligned with any electrical signal contacts 46 of each differential signal pair 50 of the adjacent centerline along a row direction that can be defined by the lateral direction A. The differential signal pairs 50 are arranged along respective row centerlines that extend equidistantly between the adjacent electrical signal contacts along the row direction.

It should be appreciated that all electrical signal contacts 46 that are disposed along a respective column centerline are spaced along the column direction with respect to all of the pairs that extend along an adjacent column centerline. Further, all electrical signal contacts that are disposed along a respective row centerline are spaced along the row direction with respect to all of the differential signal pairs on an adjacent row centerline.

While the electrical signal contacts 46 of each differential signal pair 50 is illustrated as edge coupled along the centerline 48, it should be appreciated that the electrical signal contacts 46 of each differential signal pair 50 can be broadside coupled (wherein the broadsides of the electrical signal contacts 46 of each differential signal pair 50 face each other) along the row direction. In accordance with the illustrated embodiment, the differential signal pairs 50 along each centerline 48 is spaced from adjacent differential signal pairs 50 along the respective centerline at a common distance along each of the centerlines 48. Further, the differential signal pairs 50 of each of the centerlines 48 can be spaced from the differential signal pairs of an adjacent one of the centerlines 48 by one-half the common distance. The edges of each electrical signal contact 46 are shorter than the broadsides along a common plane, for instance a common plane that is defined by the lateral direction A and the transverse direction T.

Each of the electrical ground shields 52 are disposed adjacent more than one side of the differential signal pairs 50, and include a body 54 that can define a mating end 56, and at least one or more mounting ends 58 that extends from the body 54. The mating ends 56 can be oriented substantially parallel with respect to the mounting ends 58 along the longitudinal direction L, or can be oriented substantially perpendicular with respect to the mounting ends 58 as desired. The mounting ends 58 can be configured as eye-of-the-needle press-fit tails that can be press-fit into complementary apertures or vias that extend into or through the first substrate 24. Alternatively, the mounting ends 58 can be configured to be surface mounted to the first substrate 24.

Referring to FIGS. 2A-G generally, the body 54 can define two or more walls, such as a first wall 60*a*, a second wall 60*b*, and a third wall 60*c* that can all be angularly offset with respect to each other, such as substantially perpendicular. In accordance with the illustrated embodiment, the first wall 60*a* can define a middle wall, and the second and third walls 60*b* and 60*c* can define outer walls that extend from opposed ends of the middle wall 60*a* so as to define a substantial U-shape that can include a pair of substantial L-shapes joined by a common leg so as to define the substantial U-shape. The body 54 can alternatively define only two walls that can be attached to each other so as to define a single substantial L-shape. The first wall 60*a* can extend substantially in a plane defined by the transverse direction T and the longitudinal direction L. The second and third walls 60*b-c* can extend in respective planes that can be substantially parallel to each other and defined by the lateral direction A and the longitudinal direction L. The body 54, including the walls 60*a-c* can extend forward from the front end 36 along the longitudinal direction L, and can be configured to be inserted into the housing of the second electrical connector 26 as the first and second electrical connectors 22 and 26 are mated to each other.

In accordance with the illustrated embodiment, the body 54 of each electrical ground shield at least partially surrounds a select one of the differential signal pairs 50. For instance, the body 54 extends forward from the front end 36 of the connector housing 30 along the longitudinal direction L, so as to extend from the front end 36 a distance that is at least equal to, for instance greater than, the distance that the electrical contacts 46 of the select differential signal pair 50 extends out from the front end 36 along the longitudinal direction L. Furthermore, the body 54 extends through the connector housing 30 and terminates at a location rearward of the rear end 38, and thus between the first substrate 24 and the rear end 38 of the connector housing 30 along the longitudinal direction L when the electrical connector 22 is mounted to the substrate 24.

The second and third walls 60*b-c* can define respective proximal ends 61*b-c* that are attached, for instance integrally and monolithically, to the first wall 60*a*, and opposed free distal ends 63*b-c* that are spaced from the proximal ends 61*b-c* along a plane defined by the lateral and transverse directions A and T, for instance along a select direction in the plane, which can be the lateral direction A that defines the row direction. In accordance with the illustrated embodiment, the first wall 60*a* can extend substantially parallel to the respective centerline 48 of the select differential signal pair 50, and thus can extend substantially parallel to the broadsides of the electrical signal contacts 46 of the select differential signal pair 50, and the second and third walls 60*b-c* can extend substantially perpendicular to the respective centerline 48, and thus can extend substantially parallel to the outermost edges of the electrical signal contacts 46 (it being appreciated that the opposed innermost edges of the electrical signal contacts 46 face each other).

The walls 60*a-c* can at least partially define a pocket 64, such that the electrical signal contacts 46 of the select differential signal pair 50 are disposed in the pocket 64. Thus, the first wall 60*a* can be disposed adjacent one side of the select differential signal pair (for instance adjacent a first broadside of the corresponding electrical signal contacts 46), and the distal ends 63*b-c* of the second and third walls 60*b-c* can be disposed adjacent an opposed second side of the select differential signal pair 50 (for instance adjacent a second broadside of the corresponding electrical signal contacts 46 that is opposite the first broadside). Thus, the electrical signal contacts 46 can be disposed between the first wall 60*a* and a line that connects the distal ends 63*b-c* of the second and third walls 60*b-c* (see line AA of FIG. 2E). The line can extend parallel to the first wall 60*a*. In accordance with the illustrated embodiment (e.g., see FIG. 2E), the first broadsides are spaced from the first wall 60*a* a first distance D1 along the select direction, and the second broadsides are spaced from the distal ends 63*b-c* a second distance D2 along the select direction, the second distance D2 greater than the first distance D1. For instance, the second distance can be at least twice the first distance up to ten times the first distance, including approximately 5 times greater than the first distance. Furthermore, each of first and second straight lines that extend through the respective electrical signal contacts 46 of the select differential signal pair 50 also extend through the first wall 60*a* but do not extend through each of the second and third walls 60*b* and 60*c*. The common centerline 48 of the electrical signal contacts 46 of the differential signal pair 50 can extend through both of the second and third walls 60*b* and 60*c*.

Furthermore, the second and third walls 60*b-c* define a length along the select direction from the respective proximal ends 6 l*b-c* to the respective distal ends 63*b-c*. The length can be greater than a spacing along the select direction from the distal ends 63*b-c* to the first wall 60*a* of an electrical ground shield 52 that partially surrounds a differential signal pair of an adjacent common centerline, the adjacent common centerline being spaced from the second and third walls 60*b-c* along the select direction from the proximal ends 61*b-c* to the respective distal ends 63*b-c*. It should thus be appreciated that each differential signal pair can be substantially surrounded by the respective first wall 60*a* and the second and third walls 60*b-c* of a corresponding electrical ground shield 52, and further by the first wall 60*a* of a second electrical ground shield 52 that is adjacent the corresponding electrical ground shield 52 along the select direction, and further by the second and third walls 60*b* and 60*c* of respective third and fourth ground shields 52 that at least partially surround respective differential signal pairs 50 that are spaced along the adjacent common centerline 48, it being appreciated that the first, second, third, and fourth electrical ground shields can be spaced from each other along the common centerline 48, the row direction, or both.

Figure 2F:
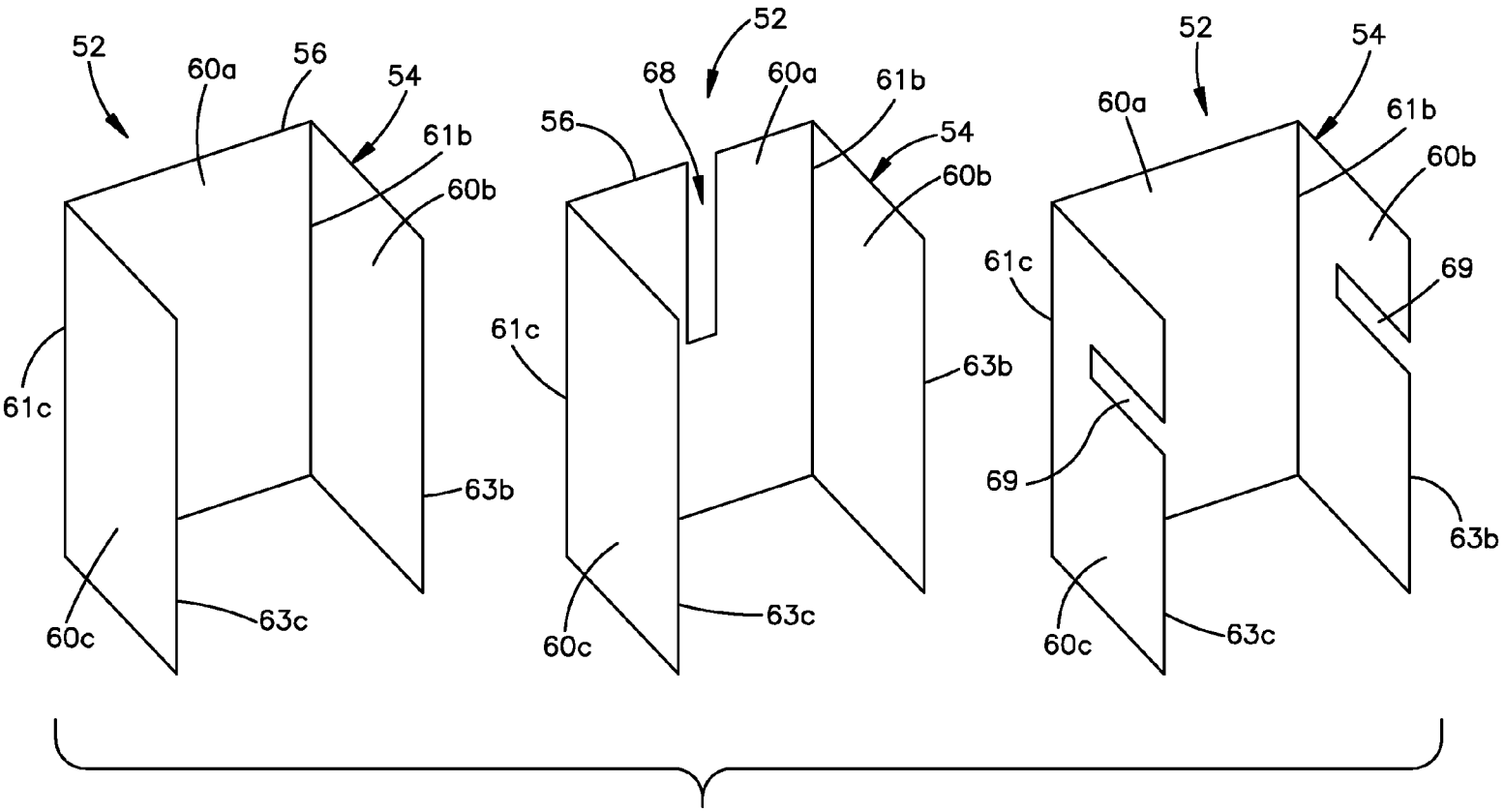
FIG. 2F shows perspective views of the ground shield as illustrated in FIG. 2B and as constructed in accordance with alternative embodiments.
Figure 2H:
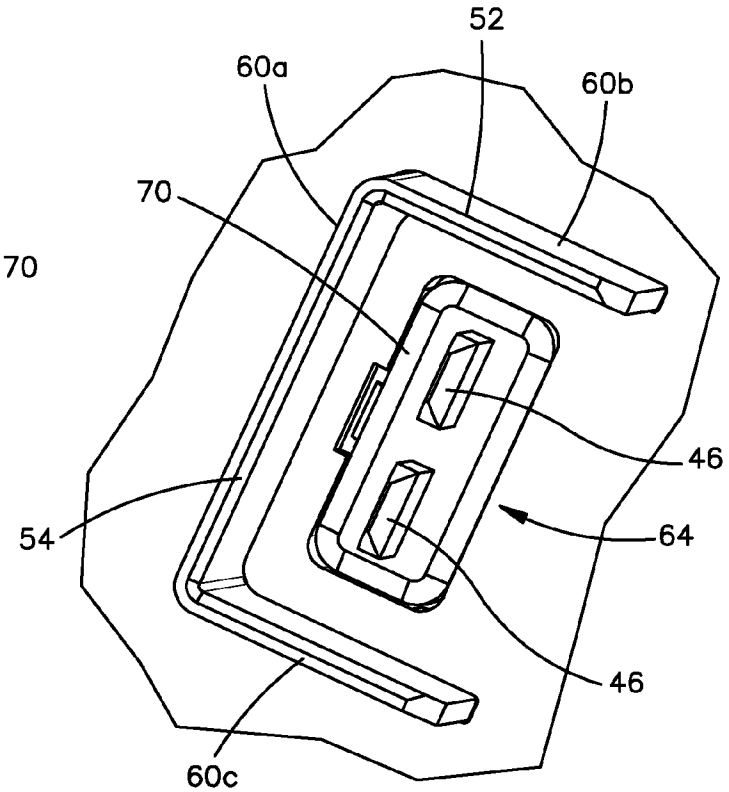
FIG. 2H is an exploded perspective view of the electrical header connector illustrated in FIG. 2G.
Figure 2G:
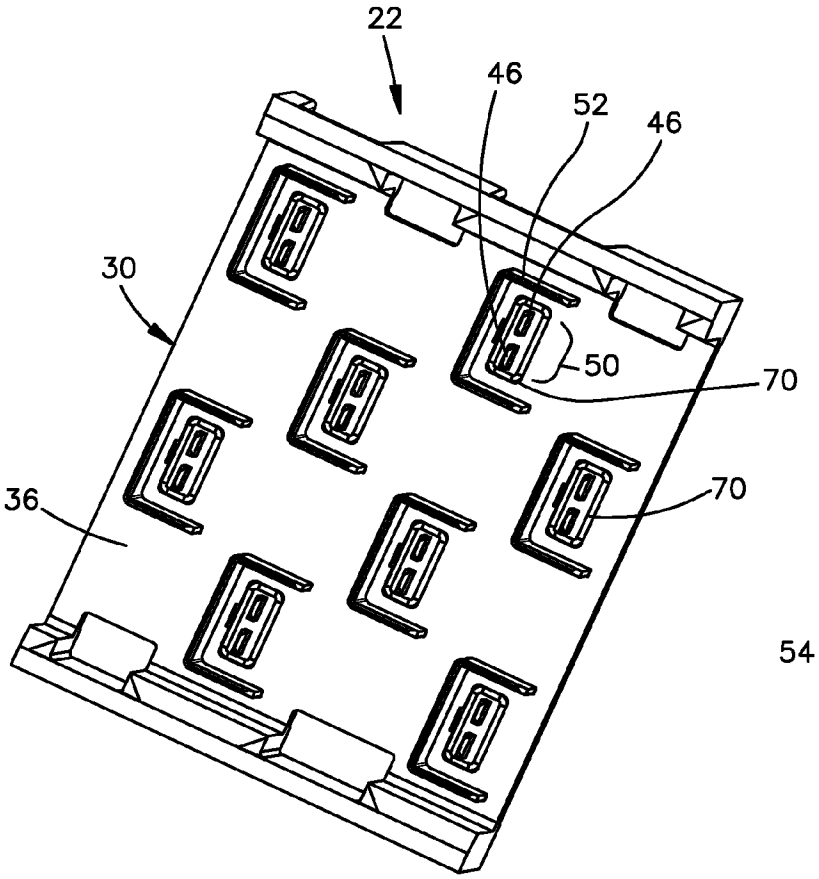
FIG. 2G is a perspective view of the electrical header connector illustrated in FIG. 2A, but constructed in accordance with an alternative embodiment.

Referring now to FIG. 2F in particular, the first wall 60*a* can extend continuously along an entirety of its length (the length extending from the mating end 56 to the lowermost end of the body 54 from which the mounting end 58 extends) from the second wall 60*b* to the third wall 60*c*. Similarly, one or both of the second and third walls 60*b* and 60*c* can extend continuously along an entirety of its length (the length extending from the mating end 56 to the lowermost end of the body 54 from which the mounting end 58 extends) from the proximal end 6 l*b-c* to the distal end 63*b-c*. Alternatively, or additionally, the first wall 60*a* can define an aperture such as a slot 68 that extends along the transverse direction from one or both of the mating end 56 and the lowermost end toward the other of the mating end 56 and the lowermost end. Alternatively, or additionally, one or both of the second and third walls can define an aperture such as a slot 69 that extend along the select direction, such as the lateral direction A, from the distal end 63*b-c* toward the proximal end 61*b-c*. While the apertures can be configured as slots, the apertures can be configured alternatively as desired. For instance, the apertures can be enclosed. It has been found that the apertures can suppress resonance frequencies encountered during operation of the electrical connector assembly 20 or shift the resonance frequencies to higher frequencies of operation.

As described above, the connector housing 30 can be configured as a dielectric or electrically insulative material, such that both the electrical signal contacts 46 and the electrical ground shields 52 are surrounded by, and in contact with, the dielectric material. Alternatively, as illustrated in FIGS. 2G-H and 8A-D, the connector housing 30 can be configured as an electrically nonconductive electrical or magnetic absorbing material (for instance an electrically nonconductive lossy material), and the electrical signal contacts can be surrounded by a second housing portion 70 that is configured as a dielectric or electrically insulative material. For instance, one or both of the electrical signal contacts 46 of one or more up to all of the differential signal pairs 50 can be overmolded by the second housing portion 70, or can alternatively be inserted, for instance stitched, into the second housing portion 70. Thus, each differential signal pair can be supported by a respective different second housing portion that is, in turn, supported by the connector housing 30 that comprises the electrical or magnetic absorbing material.

Referring to FIGS. 2A-3F, the mounting ends 58 can be defined as straight pins, and can be arranged in two pairs 58*a* and 58*b* of mounting ends 58, the mounting ends 58 of each of the two pairs 58*a* and 58*b* spaced along respective first and second directions 59*a* and 59*b* that are substantially parallel to each other. For instance, the first and second directions 59*a* and 59*b* can extend in the lateral direction A. With further reference to FIG. 1, the mounting ends 49 of the electrical signal contacts 46 of the corresponding differential signal pair 50 are aligned in a direction 57, which can define a first direction, and the first and second directions 59*a* and 59*b* can define a second direction (such as the lateral direction A) that is angularly offset to the first direction 57. For instance, the second direction can be substantially perpendicular to the first direction. The first direction can be along the transverse direction T, and the second direction can be along the lateral direction A. In accordance with one embodiment, the mounting ends 49 of the electrical signal contacts 46 of each differential signal pair 50 and the first and second pairs 58*a* and 58*b* can be arranged substantially in a U-shape (see FIG. 3A illustrating signal vias 80*a* of the first substrate 24 that receive mounting ends 49 of the pair of signal contacts 46, and first and second pairs of grounds vias 80*b* and 80*c* of the first substrate 24 that receive the first and second pairs 58*a* and 58*b* of mounting ends 58 of the second and third walls 60*b-c* of the ground shield 52. It should be further appreciated that the ground shield 52 further substantially defines a U-shape. For instance, the substantial U-shape defined by the ground shield 52 can be substantially parallel or inverted with respect to the substantial U-shape defined by the mounting ends 58 of the signal contacts 46 and associated electrical ground shield 52. The centers of the vias 80*a* can be offset with respect to centers of both of the vias of the first and second pairs 80*b* and 80*c* in two directions that are perpendicular to each other, such as the lateral direction A and the transverse direction T. The first substrate 24 can include additional vias 80*d* that reduce crosstalk between signal vias that are disposed on opposite sides of the additional vias 80*d*.

Figure 3F:
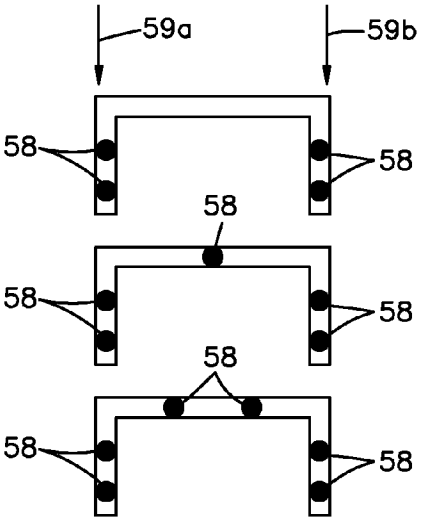
FIG. 3F are top plan views of the electrical ground shield illustrated in FIG. 2B, showing various mounting configurations onto the first substrate illustrated in FIG. 3A.
Figure 3C:
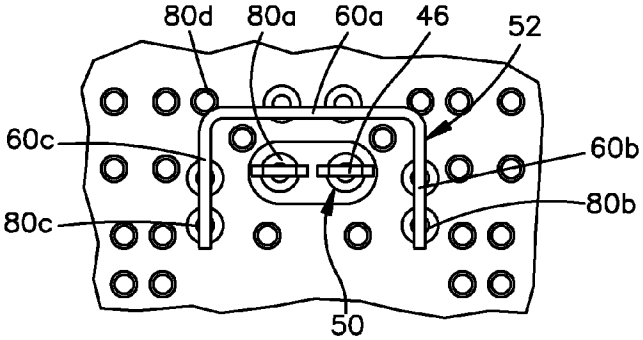
FIG. 3C is a top plan view of the electrical ground shield and the electrical signal contacts illustrated in FIG. 2D shown mounted to the first substrate.
Figure 3E:
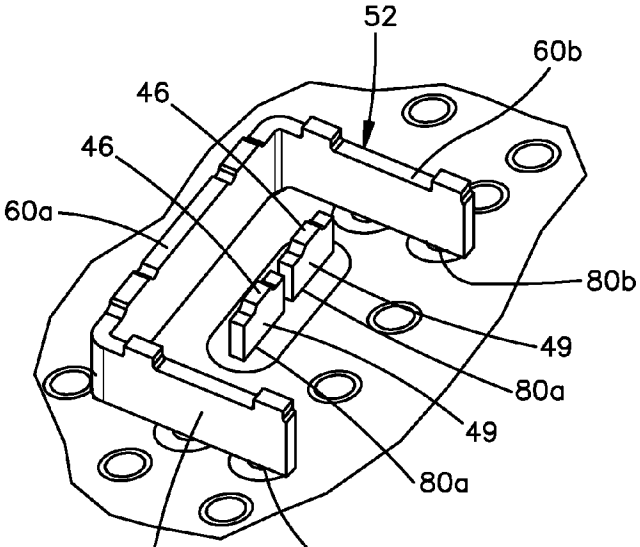
FIG. 3E is a perspective view of the electrical ground shield and the electrical signal contacts illustrated in FIG. 2D shown mounted to the first substrate as illustrated in FIG. 3D.

As illustrated in FIG. 3F, the electrical ground shields 52 can include one or more mounting ends 58 that extend from the first wall 60*a* and are configured to mount to the first substrate, for instance extend through respective ground vias that extend through the first substrate 24. It is envisioned that additional signal performance can be achieved by adding additional mounting ends that extend from the first wall 60*a*.

Referring now to FIGS. 4A-4E, the second electrical connector 26 includes a connector housing 100 that is dielectric or electrically insulative, and defines a top end 102 and an opposed bottom end 104 spaced from the top end 102 along the transverse direction T, a front end 106 and an opposed rear end 108 that is spaced from the front end 106 along the longitudinal direction L and first and second opposed sides 110 and 112, respectively, that are spaced from each other along the lateral direction A. In accordance with the illustrated embodiment, the second electrical connector 26 is configured to be mated to the first electrical connector 22 along the longitudinal direction L, which can thus define the mating direction from the rear end 108 to the front end 106. The connector housing 100 is configured to be received by the guidance arms 31 of the first electrical connector 22 so as to align the first and second electrical connectors 22 and 26 during mating. The front end 106 is configured to face the housing 30 of the first electrical connector 22 along the longitudinal direction L when the first and second electrical connectors 22 and 26 are mated. For instance, the front end 106 can be configured to abut the front end 36 of the second electrical connector 26.

The connector housing 100 thus defines a mating interface 113 disposed proximate to the front end 106 and a mounting interface 114 disposed proximate to the bottom end 104. The mounting interface 114 is configured to operatively engage the second substrate 28 (see FIGS. 5A-B), while the mating interface 113 is configured to operatively engage the first electrical connector 22. The second electrical connector 26 includes a plurality of electrical signal contacts 116 that are electrically conductive and supported by the connector housing 100, and a plurality of electrical ground shields 122 that are electrically conductive (and can be metallic) and supported by the connector housing 100 such that at least one or more up to all of the electrical ground shields 122 at least partially surrounds one or more of the electrical signal contacts 116. The ground shields 122 can be electrically isolated from each other in the second electrical connector 26, and in particular by the electrically nonconductive connector housing 100 and by leadframe housings that support the electrical signal contacts 116 as described in more detail below. Each of the electrical signal contacts 116 defines a mating end 117 disposed proximate to the mating interface 113, and an opposed mounting end 119 disposed proximate to the mounting interface 44. For instance, the mounting ends 119 can be configured as eye-of-the-needle press-fit tails that can be press-fit into complementary apertures or vias that extend into or through the second substrate 28. Alternatively, the mounting ends 119 can be configured to be surface mounted to the second substrates 28. In accordance with the illustrated embodiment, the mating interface 113 of the connector housing 100 is oriented substantially perpendicular with respect to the mounting interface 114, and the mating ends 117 of the electrical contacts 116 are oriented substantially perpendicular with respect to the mounting ends 119. Thus, the second electrical connector 26 can be referred to as a right-angle connector, and the electrical signal contacts 116 can be referred to as right electrical contacts. Further, the mating ends 117 can be define one or more, such as a pair of, resilient fingers 125 that receive the corresponding mating ends 47 of the electrical signal contacts 46 of the first electrical connector 22, and the second electrical connector 22 can be referred to as a receptacle connector. Alternatively, the second electrical connector 26 can be configured as a vertical angle connector whereby the mating interface is oriented substantially parallel with respect to the mounting interface, and the electrical signal contacts 116 can be configured as vertical electrical contacts whereby the mating ends 117 are oriented substantially parallel with respect to the mounting ends 119. Similarly, the second electrical connector 26 can be configured as a header connector, whereby the mating ends 117 are configured to be received by the mating ends 47 of the electrical signal contacts 46 of the first electrical connector 22.

Figure 8A:
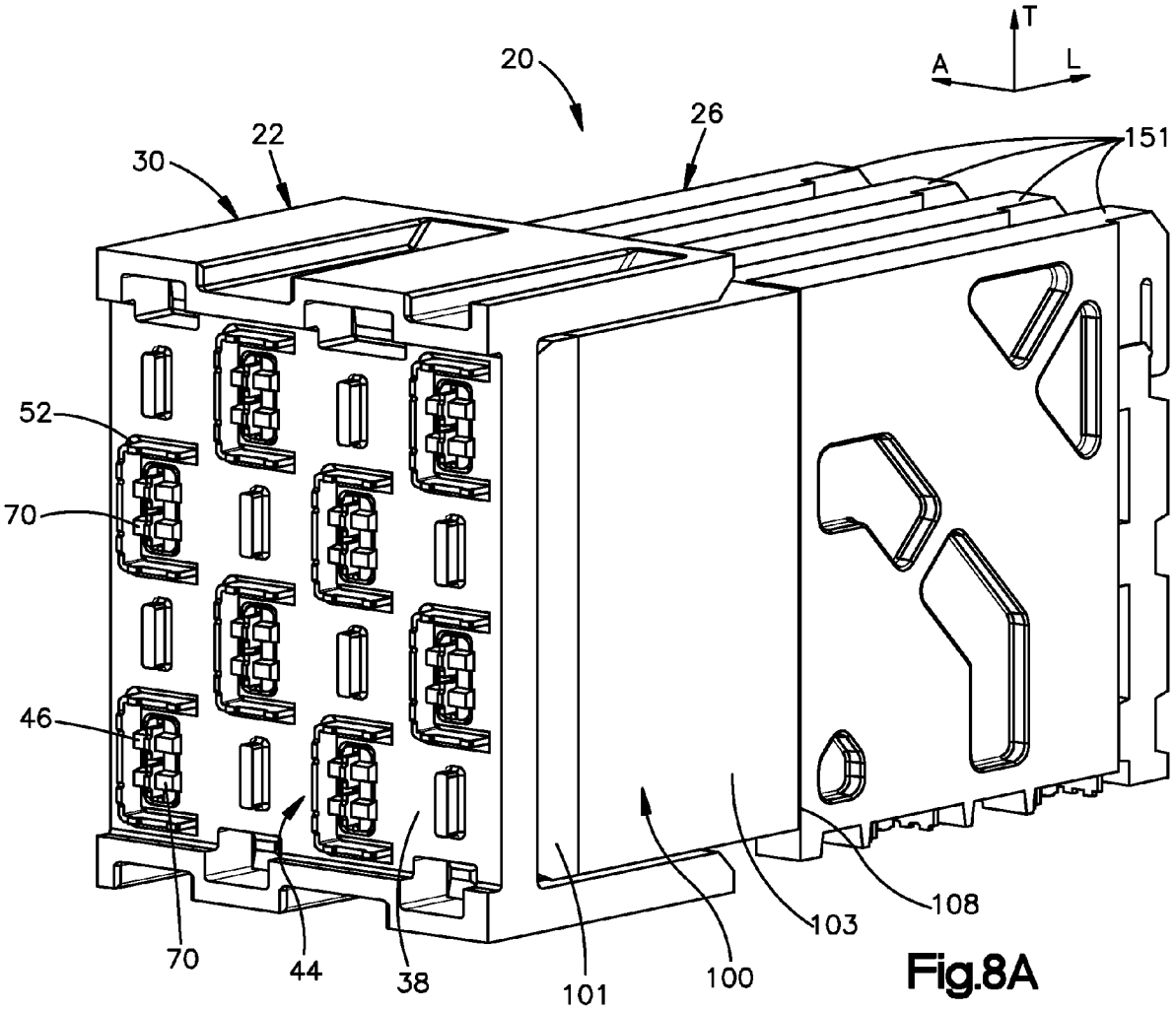
FIG. 8A is a perspective view of the electrical connector assembly including the electrical header connector illustrated in FIG. 2A, but constructed in accordance with the alternative embodiment as shown in FIG. 2G.
Figure 8B:
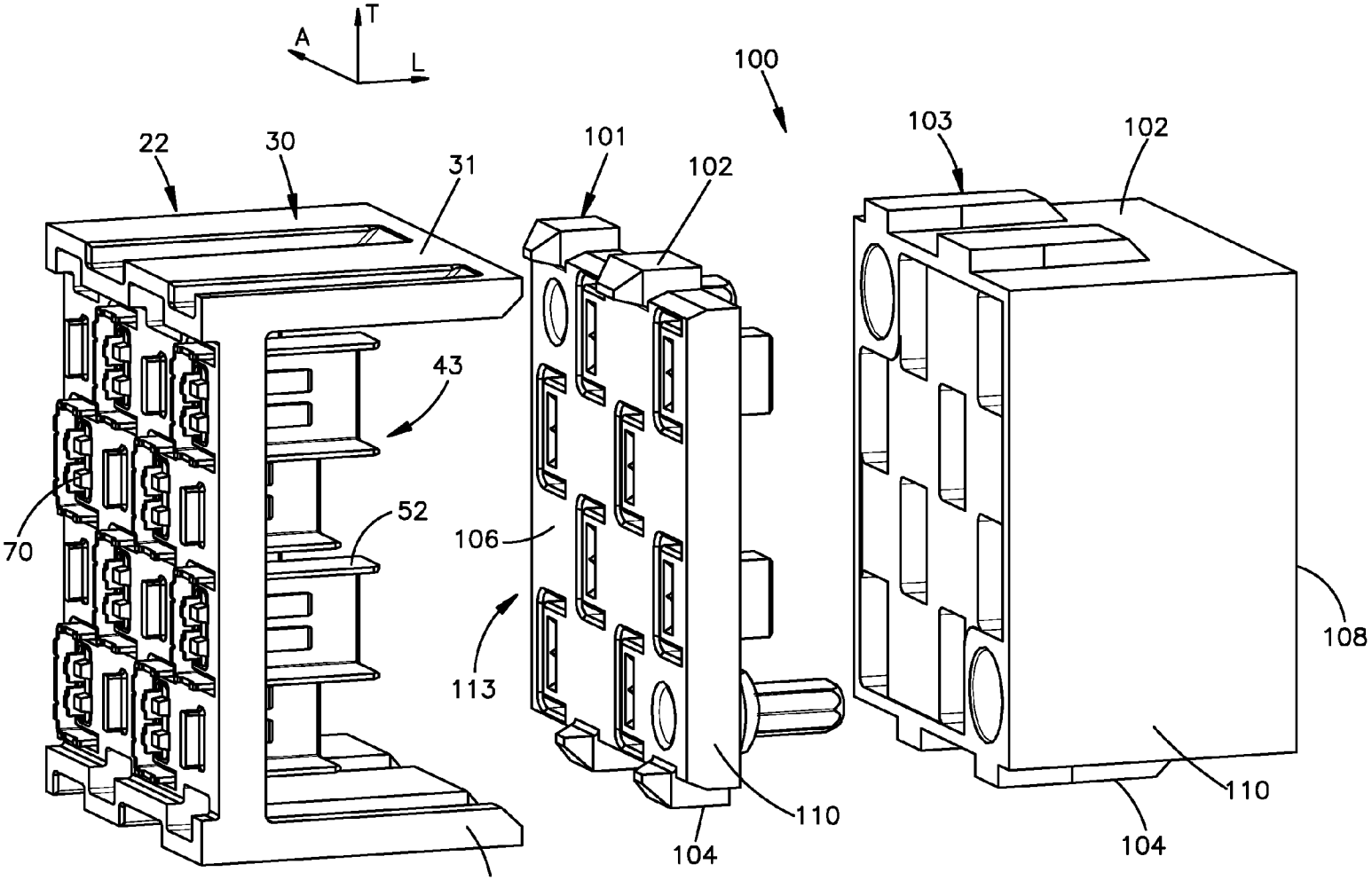
FIG. 8B is a perspective view of the electrical connector assembly shown in FIG. 8A, but showing the electrical header connector in an unmated position with the receptacle connector housing, wherein the receptacle connector housing includes first and second connector housing portions illustrated in an unattached position.
Figure 8C:
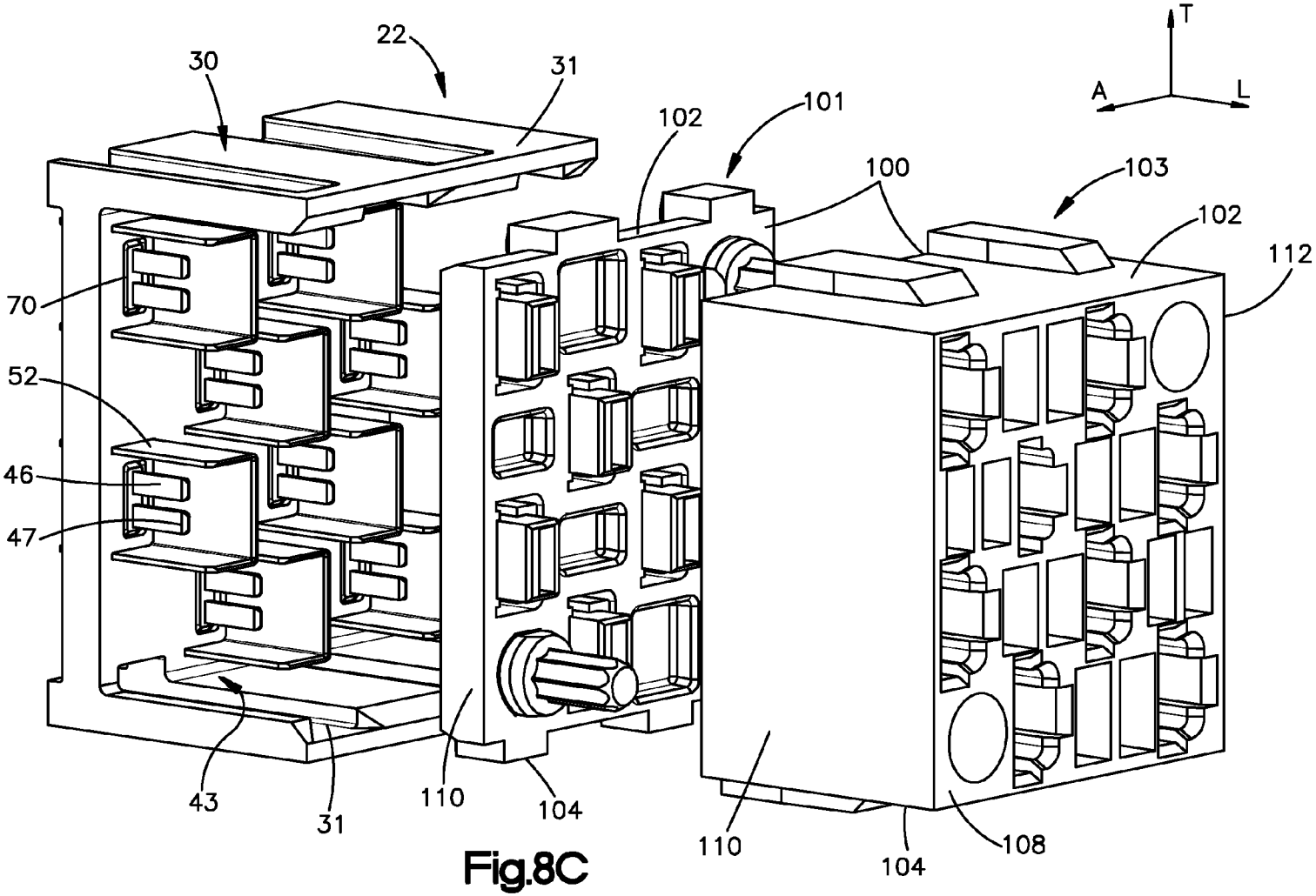
FIG. 8C is another perspective view of the electrical connector assembly as shown in FIG. 8C.
Figure 8D:
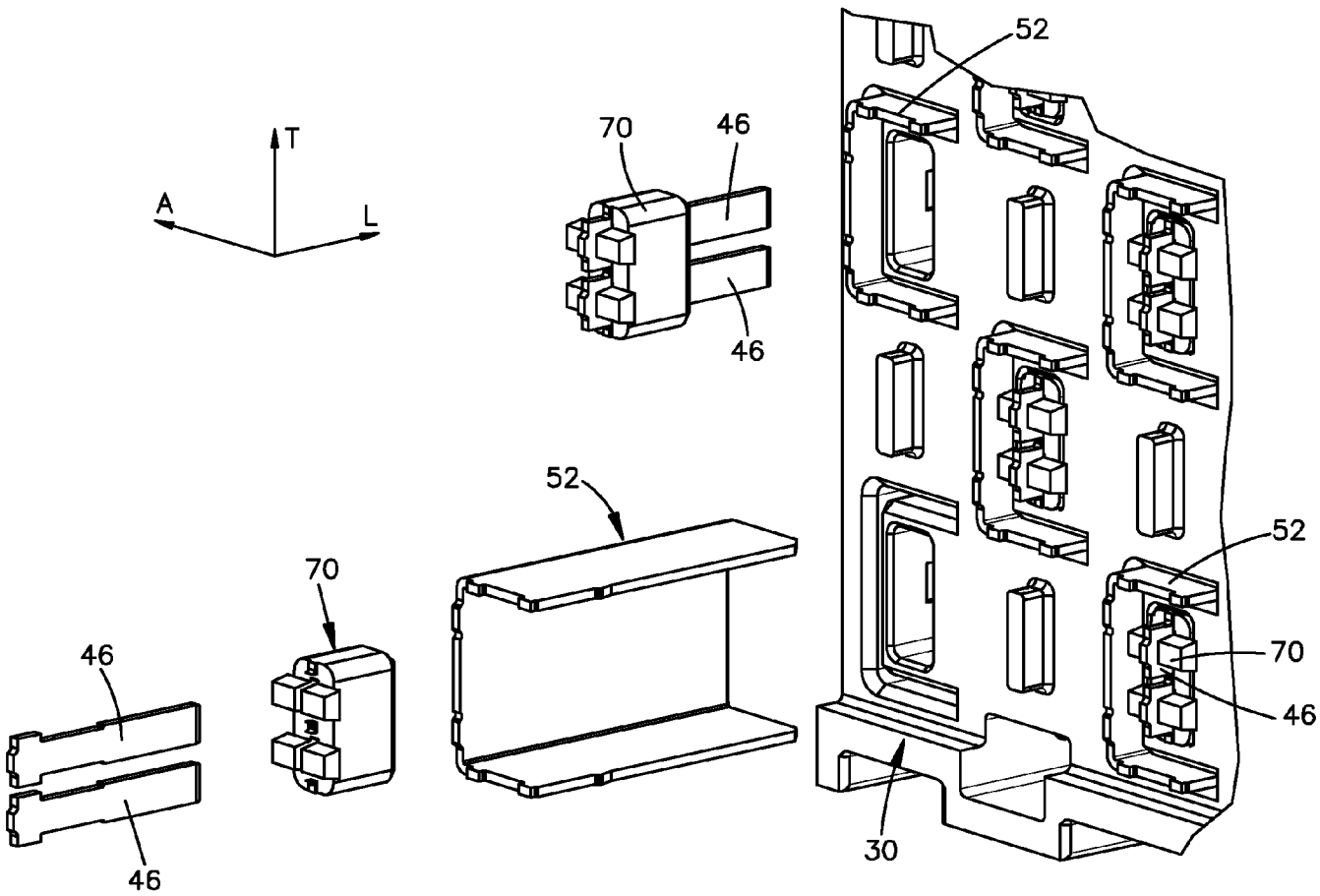
FIG. 8D is an exploded view of the header electrical connector constructed in accordance with the embodiment as shown in FIG. 2G.

Referring to FIGS. 8A-C, the connector housing 100 can include first and second connector housing portions 101 and 103, respectively, that are configured to attach to other along the longitudinal direction L. Alternatively, it will be understood that the first and second housings 101 and 103 can be monolithic with each other as desired.

The second electrical connector 26 can include a plurality of leadframe assemblies 151 that are supported by the connector housing 100 and spaced from each other along the row direction. Each leadframe assembly 151 can include a dielectric, or electrically insulative, leadframe housing 153, and select ones of the plurality of the electrical signal contacts 116 that are overmolded by or stitched into the dielectric leadframe housing 153. The mating ends 117 can extend forward from the respective leadframe housing 153, and the mounting ends 119 can extend down from the leadframe housing 153.

The electrical signal contacts 116 can be arranged along a plurality of parallel column centerlines 118 which each extend along a column direction, such that adjacent electrical signal contacts 116 are edge-coupled (wherein the edges of the electrical signal contacts 46 that define a differential signal pair 120 face each other) along the respective centerlines 118 so as to define differential signal pairs 120. The differential signal pairs 120 of each centerline 118 can be offset with respect to all of the differential signal pairs 120 of respective adjacent centerlines 118 such that none of the electrical signal contacts 116 of each differential signal pair 120 of one centerline 118 are aligned with any electrical signal contacts 116 of each differential signal pair 120 of the adjacent centerline along a row direction that can be defined by the lateral direction A. The differential signal pairs 120 are arranged along respective row centerlines that extend equidistantly between the adjacent electrical signal contacts along the row direction.

It should be appreciated that all electrical signal contacts 116 that are disposed along a respective column centerline are spaced along the column direction with respect to all of the pairs that extend along an adjacent column centerline. Further, all electrical signal contacts that are disposed along a respective row centerline are spaced along the row direction with respect to all of the differential signal pairs on an adjacent row centerline.

While the electrical signal contacts 116 of each differential signal pair 120 are illustrated as edge coupled along the column centerline 118, it should be appreciated that the electrical signal contacts 116 of each differential signal pair 120 can be broadside coupled (wherein the broadsides of the electrical signal contacts 116 of each differential signal pair 120 face each other) along the row direction. In accordance with the illustrated embodiment, the differential signal pairs 120 along each centerline 118 is spaced from adjacent differential signal pairs 120 along the respective centerline 118 at a common distance along each of the centerlines 118. Further, the differential signal pairs 120 of each of the centerlines 118 can be spaced from the differential signal pairs of an adjacent one of the centerlines 118 by one-half the common distance. The edges of each electrical signal contact 116 are shorter than the broadsides along a common plane, for instance a common plane that is defined by the lateral direction A and the transverse direction proximate to the mating interface 113, and defined by the lateral direction and the longitudinal direction L proximate to the mounting interface 114.

Each of the electrical ground shields 122 are disposed adjacent more than one side of the differential signal pairs 120, and includes a body 124, a mating end 126 that extends forward from the body 124 along the longitudinal direction L, and at least one or more mounting ends 128 that extends down from the body 124 along the transverse direction T. The mating ends 126 can be oriented substantially perpendicular with respect to the mounting ends 128, or can be oriented substantially perpendicular with respect to the mounting ends 128 as desired. The mounting ends 128 can be configured as eye-of-the-needle press-fit tails that can be press-fit into complementary apertures or vias that extend into or through the second substrate 28. Alternatively, the mounting ends 128 can be configured to be surface mounted to the second substrate 28.

The body 124 can define two or more walls, such as a first wall 130*a*, a second wall 130*b*, and a third wall 130*c* that can be all angularly offset with respect to each other, such as substantially perpendicular to each other. In accordance with the illustrated embodiment, the first wall 130*a* can define a middle wall, and the second and third walls 130*b* and 130*c* can define outer walls that extend from opposed ends of the middle wall 130*a* so as to define a substantial U-shape that can include a pair of substantial L-shapes joined by a common leg so as to define the substantial U-shape. The body 124 can alternatively define only two walls that can be attached to each other so as to define a single substantial L-shape. The body mating ends 126 can be recessed with respect to the front end 106 along the longitudinal direction L, and are configured to contact the body 54, for instance at the mating end 56, of the electrical ground shield 54 of the first electrical connector 22. For instance, the connector housing 100 defines a plurality of substantially U-shaped slots that extend through the front end 106 along the longitudinal direction L, the U-shaped slots 159 configured to receive the U-shaped electrical ground shields 52 of the first electrical connector, including the mating end 56 of the ground shields 52, such that the mating ends 126 of the ground shields 122, which can be configured as resilient fingers, contact the mating end 56 of the ground shields 52 so as to place the ground shields 52 and 112 in electrical contact with each other. In accordance with the illustrated embodiment, the mating ends 126 can be configured as one or more resilient fingers that extend forward from one or more up to all the first wall 130*a*, the second wall 130*b*, and the third wall 130*c* and are configured to contact the corresponding first wall 60*a*, the second wall 60*b*, and the third wall 60*c*, respectively, of the electrical ground shield 52 when the first and second electrical connectors 22 and 24 are mated to each other (see FIGS. 6E-G). As illustrated in FIG. 6I, the electrical ground shield 122 can define as many fingers at the mating end 126 that extend from the first wall 130*a*, such as one or two or any alternative number as desired. Similarly, the electrical ground shield 122 can define as many fingers at the mating end 126 as desired, such as one or none or more than one.

In accordance with the illustrated embodiment, the ground shields 122 can be snap-fit into, or otherwise supported by, respective sides of the leadframe housing 153 that supports the electrical signal contacts 116 that at least partially define the differential signal pair 150. For instance, the second and third walls 60*b* and 60*c* can extend into the leadframe housing 153, such as a laterally outer side of the leadframe housing 153, and the first wall 60*a* can extend substantially parallel to the laterally outer side of the leadframe housing 153. The first wall 60*a* can be substantially flush with, recessed with respect to, or outwardly spaced from, the laterally outer side of the leadframe housing 153.

In accordance with the illustrated embodiment, the body 124 of each electrical ground shield at least partially surrounds a select one of the differential signal pairs 120. For instance, the body 124 surrounds the electrical contacts 35 between the mating ends 117 and the mounting ends 119. Furthermore, the body 124 extends down through the bottom end 104 of the connector housing 100 and terminates at a location below the bottom end 104, and thus between the second substrate 28 and the bottom end 104 of the connector housing 100 along the transverse direction T.

The second and third walls 130*b-c* can define respective proximal ends that are attached, for instance integrally and monolithically, to the first wall 130*a*, and opposed free distal ends that are spaced from the proximal ends. In accordance with the illustrated embodiment, the first wall 130*a* can extend substantially parallel to the respective centerline 118 of the select differential signal pair 120, and thus can extend substantially parallel to the broadsides of the electrical signal contacts 116 of the select differential signal pair 120, and the second and third walls 130*b-c* can extend substantially perpendicular to the respective centerline 118, and thus can extend substantially parallel to the outermost edges of the electrical signal contacts 116 (it being appreciated that the opposed innermost edges of the electrical signal contacts 116 face each other).

The walls 130*a-c* can at least partially define a pocket 134, such that the electrical signal contacts 116 of the select differential signal pair 120 are disposed in the pocket 134. Thus, the first wall 130*a* can be disposed adjacent one side of the select differential signal pair (for instance adjacent a first broadside of the corresponding electrical signal contacts 116), and the distal ends of the second and third walls 130*b-c* can be disposed adjacent an opposed second side of the select differential signal pair 120 (for instance adjacent a second broadside of the corresponding electrical signal contacts 116 that is opposite the first broadside). Thus, the electrical signal contacts 116 can be disposed between the first wall 130*a* and a line that connects the distal ends of the second and third walls 130*b-c*. The line can extend parallel to the first wall 130*a*. In accordance with the illustrated embodiment, the first broadsides are spaced from the first wall 130*a* a first distance along the select direction, and the second broadsides are spaced from the distal ends a second distance along the select direction, the second distance greater than the first distance. For instance, the second distance can be at least twice the first distance up to ten times the first distance, including approximately 5 times greater than the first distance. Furthermore, each of first and second straight lines that extend through the respective electrical signal contacts 46 of the select differential signal pair 120 also extend through the first wall 130*a* but do not extend through each of the second and third walls 130*b* and 130*c*. The common centerline 118 of the electrical signal contacts 116 of the differential signal pair 120 can extend through both of the second and third walls 130*b* and 130*c*.

Furthermore, the second and third walls 130*b-c* define a length along the select direction from the respective proximal ends to the respective distal ends. The length can be greater than a spacing along the select direction from the distal ends to the first wall 130*a* of an electrical ground shield 122 that partially surrounds a differential signal pair 120 of an adjacent common centerline 118, the adjacent common centerline being spaced from the second and third walls 130*b-c* along the select direction from the proximal ends to the respective distal ends. It should thus be appreciated that each differential signal pair 120 can be substantially surrounded by the respective first wall 130*a* and the second and third walls 130*b-c* of a corresponding electrical ground shield 122, and further by the first wall 130*a* of a second electrical ground shield 122 that is adjacent the corresponding electrical ground shield 122 along the select direction, and further by the second and third walls 130*b* and 130*c* of respective third and fourth ground shields 122 that at least partially surround respective differential signal pairs 120 that are spaced along the adjacent common centerline 118, it being appreciated that the first, second, third, and fourth electrical ground shields 122 can be spaced from each other along the common centerline 118, the row direction, or both.

As described above, the connector housing 100 can be configured as a dielectric or electrically insulative material. Alternatively, the connector housing 100 can be configured as an electrically nonconductive electrical or magnetic absorbing material (for instance an electrically nonconductive lossy material). For instance, when the connector housing 30 of the first electrical connector 22 comprises a dielectric material, the connector housing 100 can comprise the nonconductive electrical or magnetic absorbing material. Conversely, when the connector housing 30 of the first electrical connector 22 comprises a nonconductive electrical or magnetic absorbing material, the connector housing 100 can comprise a dielectric material.

Figure 5B:
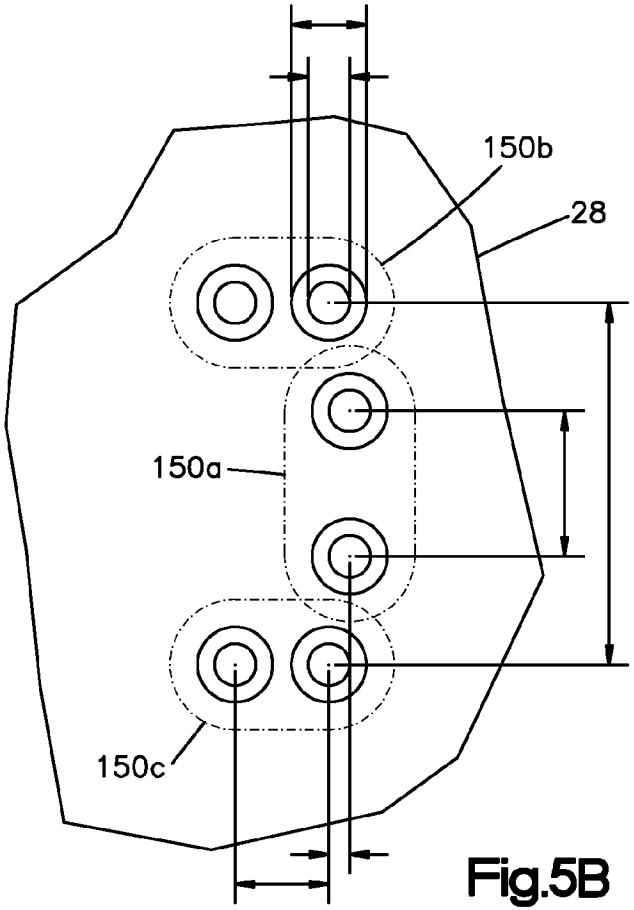
FIG. 5B is an exploded top plan view of a portion of the second substrate illustrated in FIG. 5A.
Figure 5A:
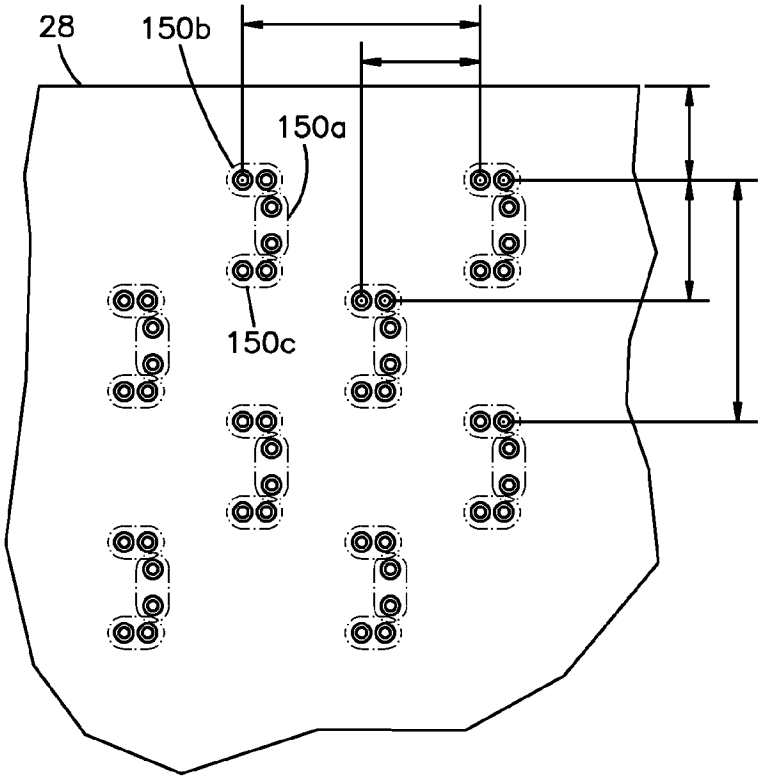
FIG. 5A is a top plan view of a second substrate to which the electrical receptacle connector illustrated in FIGS. 4A-4C is configured to be mounted, the top plan view showing a footprint of the second substrate.

Referring also to FIGS. 5A-B, the mounting ends 128 can be defined as straight pins, and can be arranged in two pairs 128*a* and 128*b* of mounting ends 128, the mounting ends 128 of each of the two pairs 128*a* and 128*b* spaced along respective first and second directions 129*a* and 129*b* that are substantially parallel to each other. For instance, the first and second directions 129*a* and 129*b* can extend in the lateral direction A. The mounting ends 119 of the electrical signal contacts 116 of the corresponding differential signal pair 120 are aligned in a direction 127, which can define a first (e.g., longitudinal) direction, and the first and second directions are aligned in a direction 127, which can define a first direction, and the first and second directions 129*a* and 129*b* can define a second direction (such as the lateral direction A) that is angularly offset to the first direction 127. For instance, the second direction can be substantially perpendicular to the first direction. The first direction can be along the longitudinal direction L, and the second direction can be along the lateral direction A. In accordance with one embodiment, the mounting ends 119 of the electrical signal contacts 116 of each differential signal pair 120 and the first and second pairs 128*a* and 128*b* can be arranged substantially in a U-shape (see FIG. 5A illustrating signal vias 150*a* of the second substrate 28 that receive mounting ends 119 of the pair of signal contacts 116, and first and second pairs of grounds vias 150*b* and 150*c* of the second substrate 28 that receive the first and second pairs 128*a* and 128*b* of mounting ends 128 of the second and third walls 130*b-c* of the ground shield 122). It should be further appreciated that the ground shield 122 further substantially defines a U-shape. For instance, the substantial U-shape defined by the ground shield 122 can be substantially parallel or inverted with respect to the substantial U-shape defined by the mounting ends 119 and 128 of the signal contacts 116 and associated electrical ground shield 122. The centers of the vias 150*a* can be offset with respect to centers of both of the vias of the first and second pairs 150*b* and 150*c* in two directions that are perpendicular to each other, such as the lateral direction A and the longitudinal direction L.

It should be appreciated that the second substrate 28 can include additional vias that reduce crosstalk between signal vias that are disposed on opposite sides of the additional vias. Furthermore, it should be appreciated that the electrical ground shields 122 can include one or more mounting ends 128 that extend from the first wall 130*a* and are configured to mount to the second substrate 28, for instance extend through respective ground vias that extend through the second substrate 28.

Figure 4A:
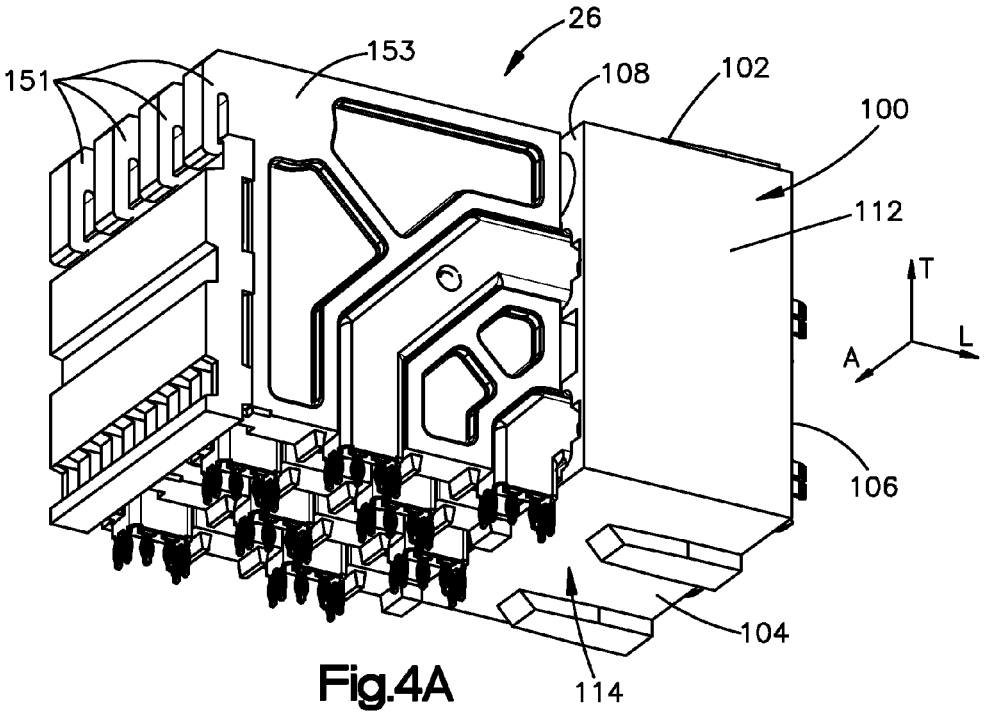
FIGS. 4A-C are perspective views of the electrical receptacle connector illustrated in FIG. 1, showing a connector housing, and a plurality of ground shields and electrical signal contacts supported by the connector housing.
Figure 4B:
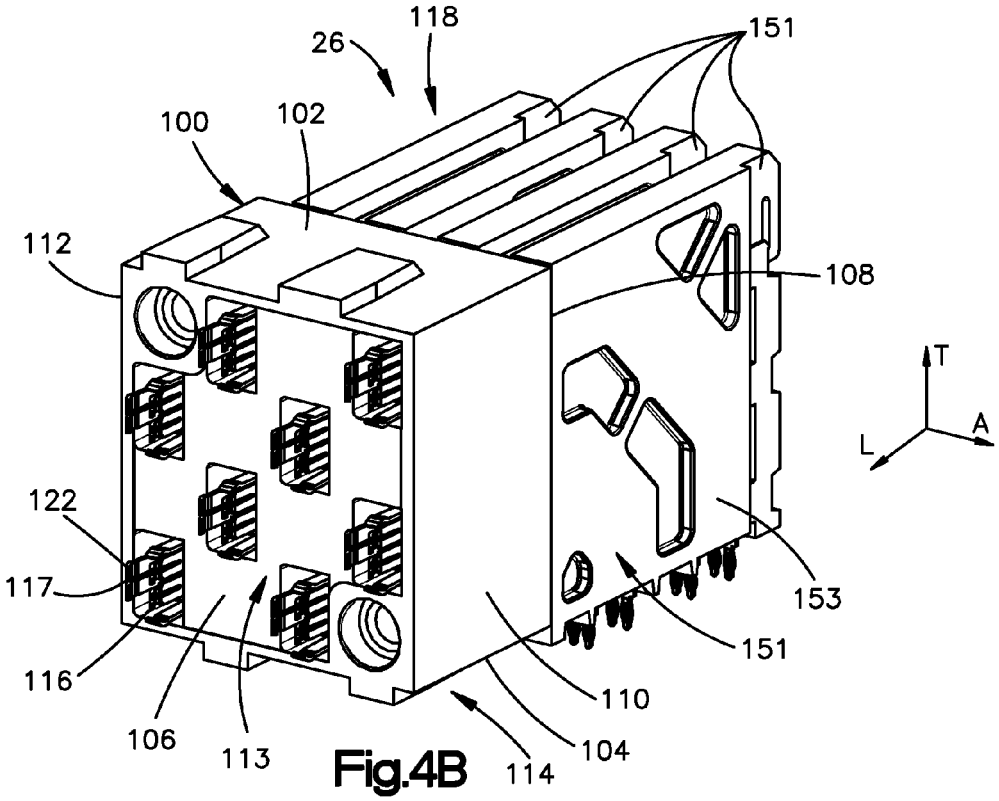
Figure 4C:
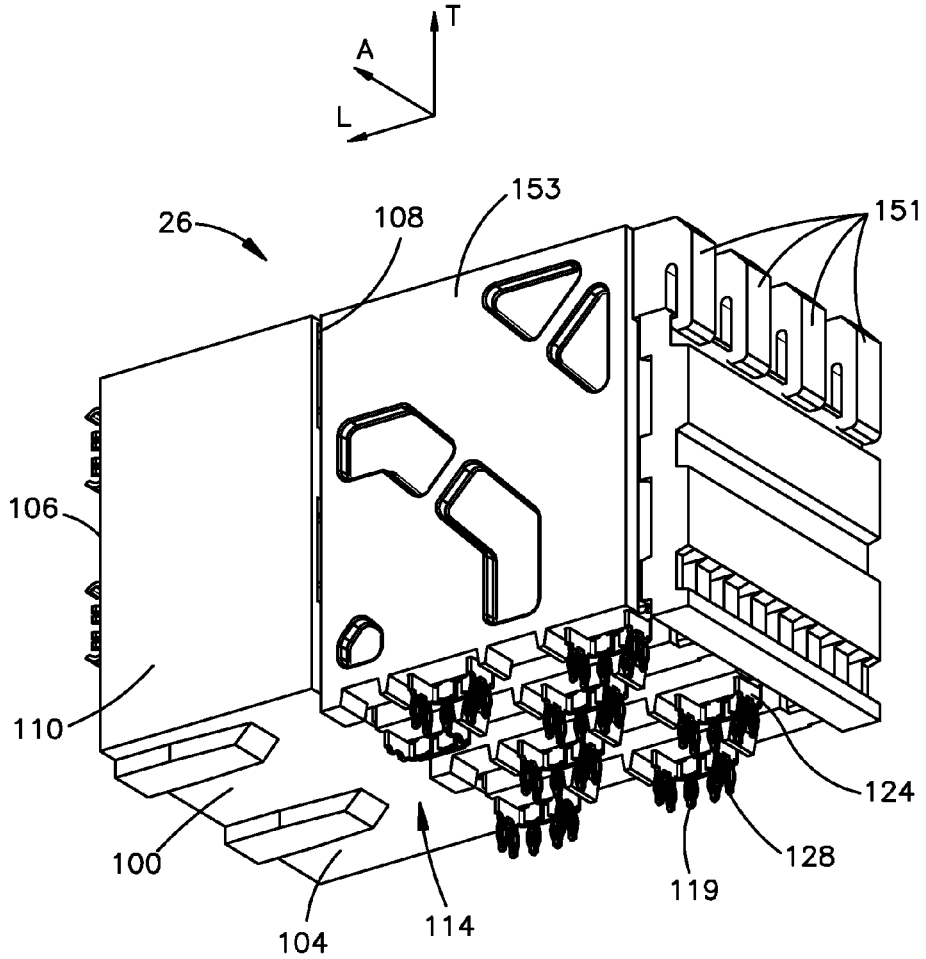
Figure 4D:
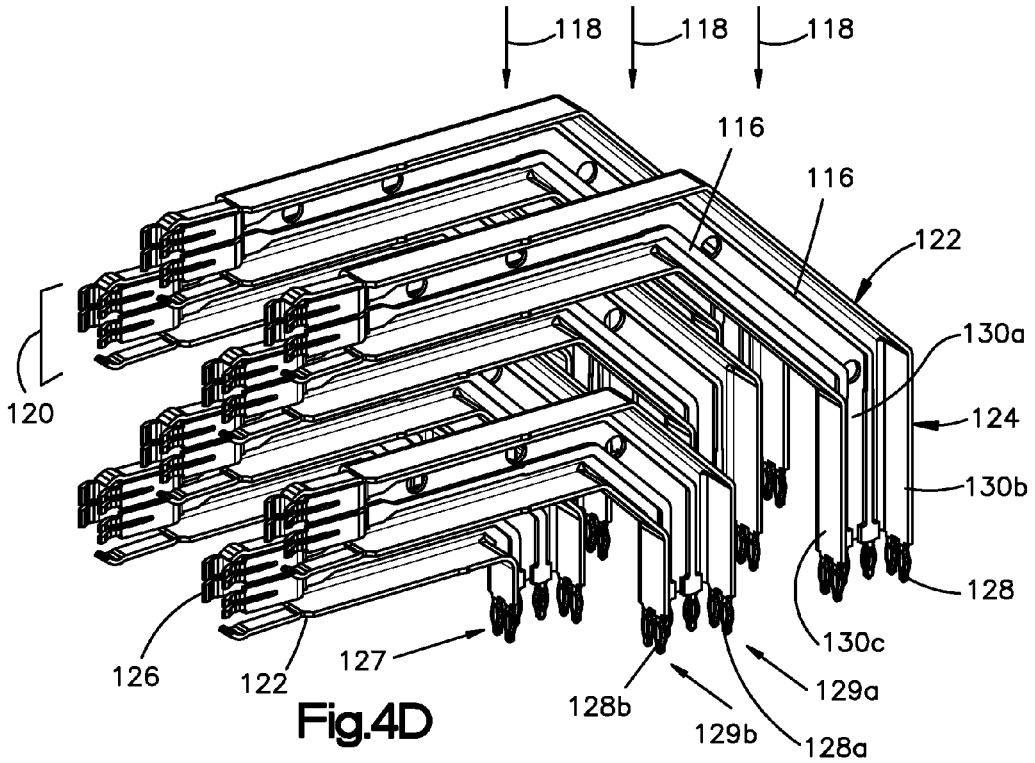
FIG. 4D is a perspective view of the electrical signal contacts and the electrical ground shields illustrated in FIGS. 4A-C.
Figure 4E:
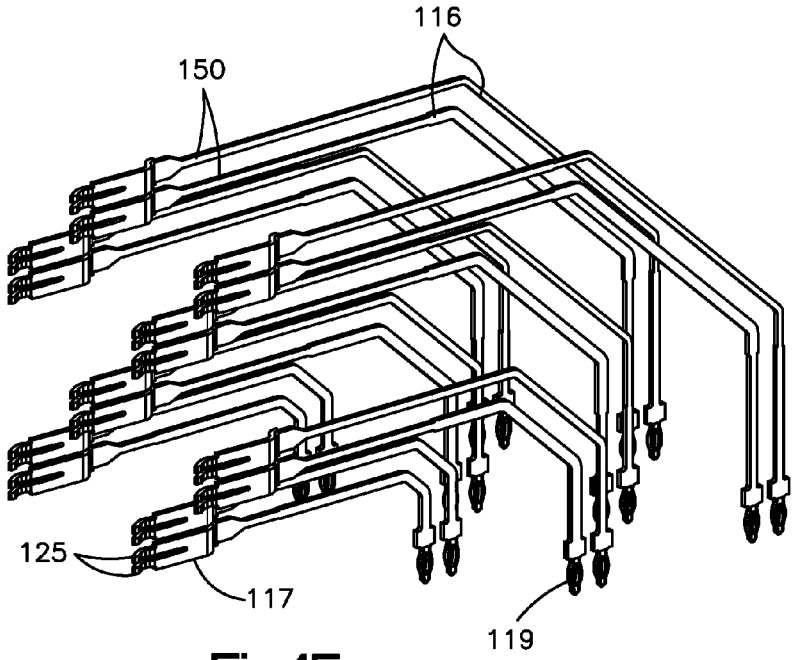
FIG. 4E is a perspective view of the electrical signal contacts illustrated in FIG. 4D.
Figure 4H:
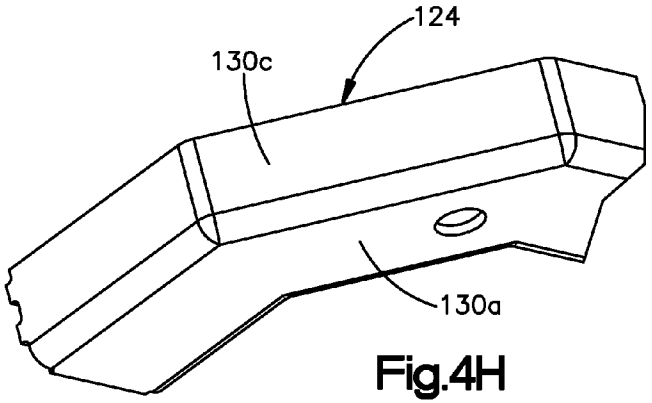
FIG. 4H is another perspective view of a portion of the electrical ground shield illustrated in FIG. 4F.
Figure 4I:
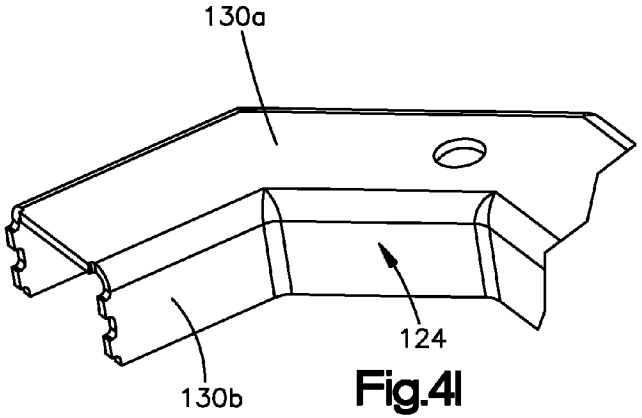
FIG. 4I is another perspective view of a portion of the electrical ground shield illustrated in FIG. 4F.
Figure 4F:
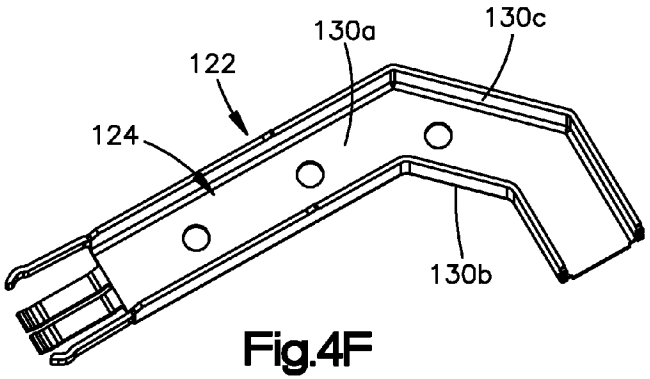
FIG. 4F is a perspective view of a portion of one of the electrical ground shields illustrated in FIG. 4D.
Figure 4G:
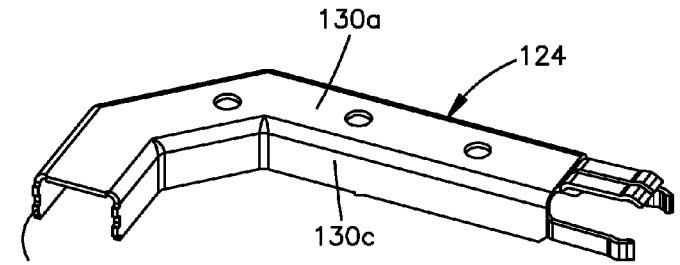
FIG. 4G is another perspective view of a portion the electrical ground shield illustrated in FIG. 4F.

It should be appreciated that the electrical ground shields 122 can define right-angle ground shields whereby the mating ends 126 are oriented substantially perpendicular to the mounting ends 128. Thus, as illustrated in FIGS. 4F-4I, the bodies 124 of the ground shields 122 can be bent so as to define bent regions between the mating ends 126 and the mounting ends 128. The bent regions can define gaps created during the bending operations as shown in FIGS. 4F and 4G, and the gaps can be closed, for instance by stretching the bodies 124 so as to extend across and cover the gaps as illustrated in FIGS. 4H and 4I.

Figure 6A:
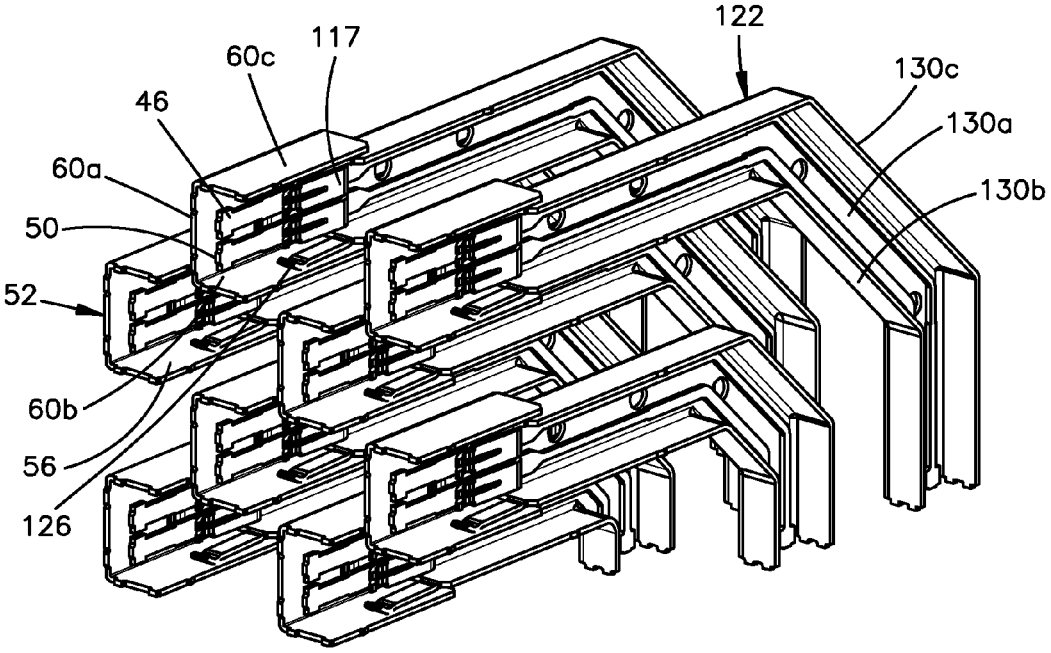
FIG. 6A is a perspective view of the electrical connector assembly illustrated in FIG. 1, with portions removed, showing the electrical header connector mated to the electrical receptacle connector.
Figure 6B:
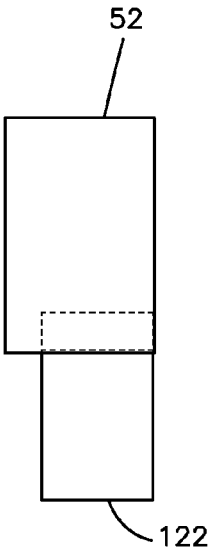
FIGS. 6B-C show schematic side elevation views of the electrical ground shield of the electrical header connector mated to the electrical ground shield of the electrical receptacle connector, as illustrated in FIG. 6A.
Figure 6C:
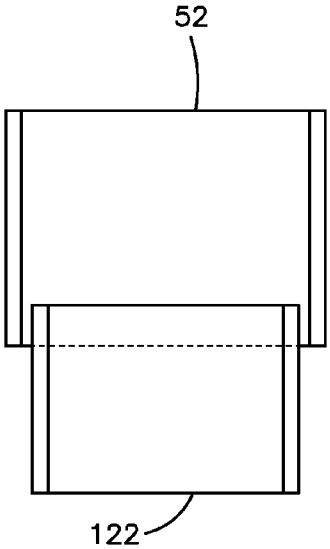
Figure 6D:
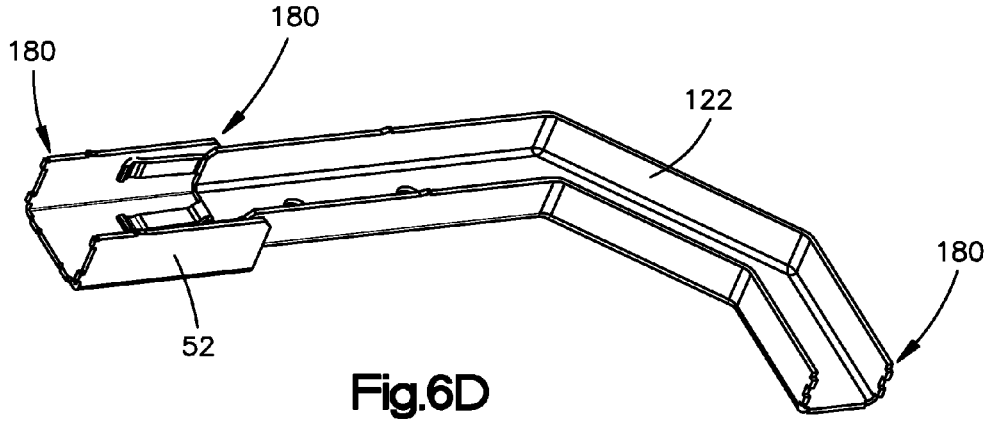
FIG. 6D is a perspective view showing the electrical ground shield of the electrical header connector mated to the electrical ground shield of the electrical receptacle connector, as illustrated in FIG. 6A.
Figure 6E:
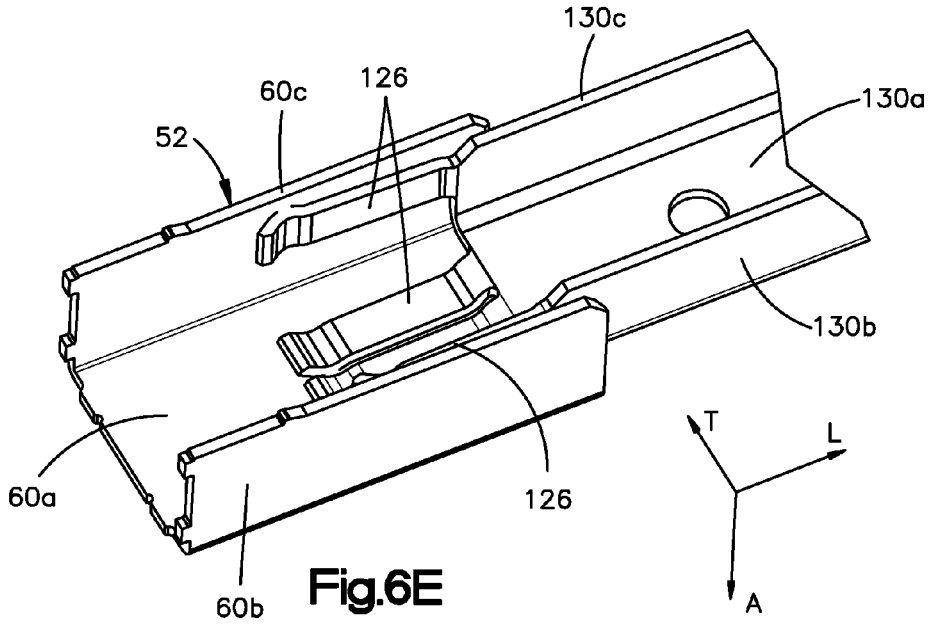
FIG. 6E is a perspective view showing a mating portion of the electrical ground shield of the electrical header connector mated to a mating portion of the electrical ground shield of the electrical receptacle connector, as illustrated in FIG. 6D.
Figure 6F:
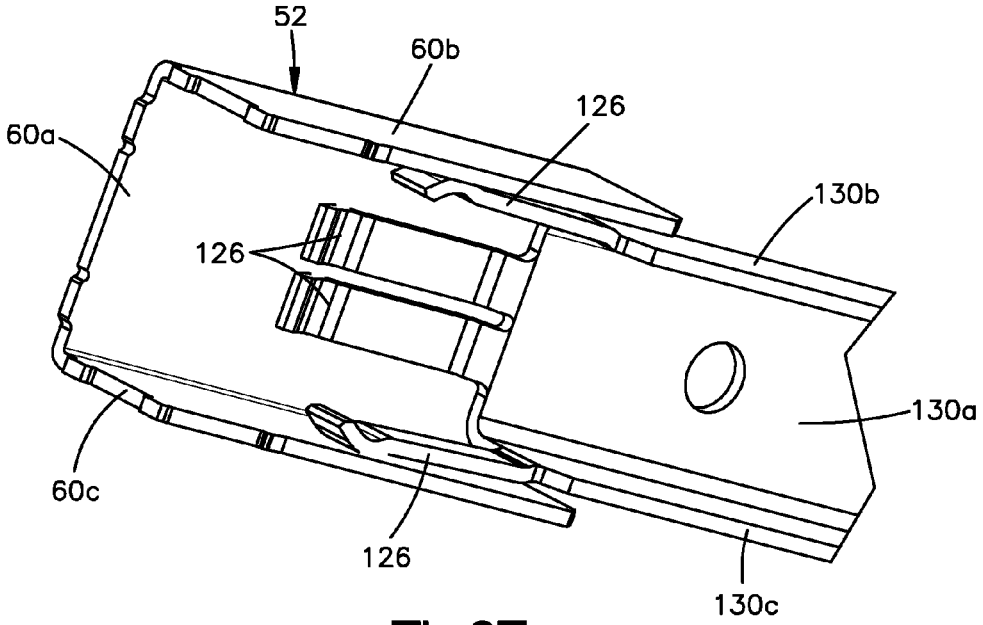
FIG. 6F is a perspective view showing a mating portion of the electrical ground shield of the electrical header connector mated to a mating portion of the electrical ground shield of the electrical receptacle connector, as illustrated in FIG. 6D.
Figure 6G:
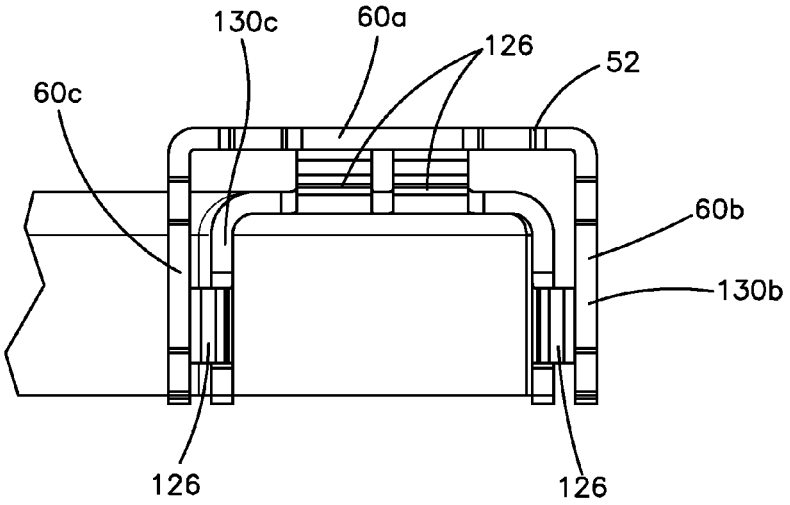
FIG. 6G is an end elevation view showing the electrical ground shield of the electrical header connector mated to the electrical ground shield of the electrical receptacle connector, as illustrated in FIG. 6D.
Figure 6H:
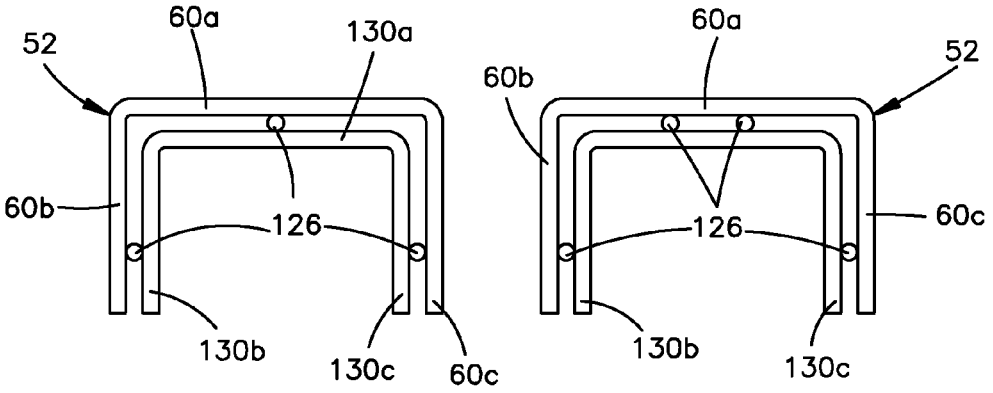
FIG. 6H shows schematic end elevation views of different mating interfaces between the electrical ground shield of the electrical header connector mated to the electrical ground shield of the electrical receptacle connector, as illustrated in FIG. 6D.
Figure 6I:
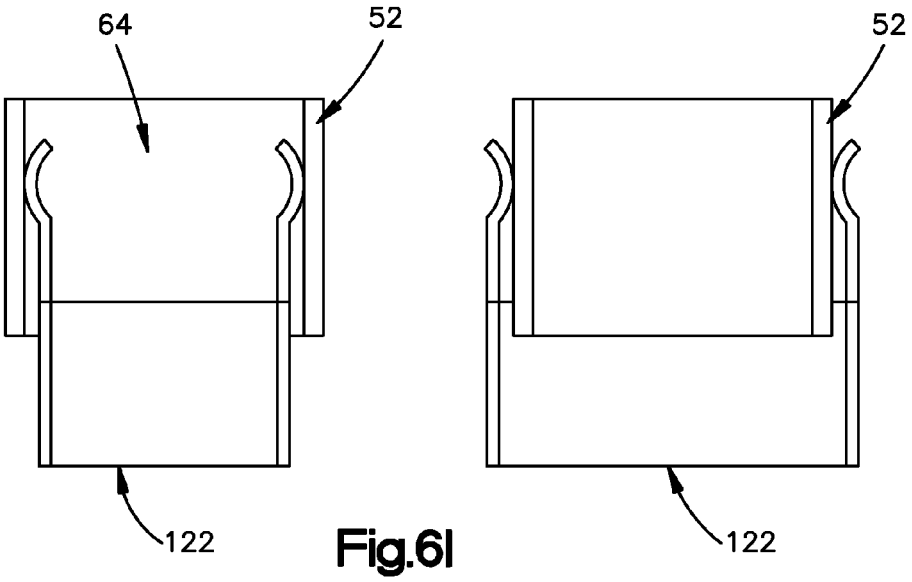
FIG. 6I shows side elevation views of the electrical ground shield of the electrical header connector mated to the electrical ground shield of the electrical receptacle connector in accordance with alternative embodiments.

Referring now to FIGS. 6A-B, the electrical ground shields 52 and 122 are shown mated to each other, whereby a portion of the electrical ground shields 52, such as the mating ends 56, extend through the slots 159 that extend through the front end 106 of the connector housing 100. Similarly, the mating ends 47 of the electrical signal contacts 46 of the first electrical connector 22 are inserted through openings 161 that extend through the front end 106 of the connector housing 100 and are partially surrounded by the slots 159, such that the mating ends 47 can contact the mating ends 117 of the electrical signal contacts 116. Thus, the bodies 54 and 124 can overlap, and the fingers defined by the mating ends 126 contact the mating ends 56 of the electrical ground shields as described above. Alternatively, the mating ends 56 of the electrical ground shields 52 can define fingers that contact the bodies 124 of the electrical ground shields 122. Furthermore, while the electrical ground shields 52 extend through the front end of the connector hosing 100 of the second electrical connector, the electrical ground shields 122 can alternatively or additionally extend through the front end, for instance U-shaped slots that extend through the front end, of the connector housing 30 of the first electrical connector 22. As illustrated in FIG. 6D, corners at the mounting and mating ends of the ground shields 52 and 122 can be rounded so as to define rounded regions 180 that are devoid of sharp edges.

Referring now to FIG. 6I, it should be appreciated that the electrical ground shield 52 of the first electrical connector 52 can receive the electrical ground shield 122 of the second electrical connector 122, such that the mating ends 126 contact an inner surface of the electrical ground shield 52 that defines the pocket 64. Alternatively, the second electrical ground shield 122 can receive the electrical ground shield 52 of the first electrical connector 22, such that the mating ends 126 contact an outer surface of the electrical ground shield 52 that is opposite the inner surface that defines the pocket 64. It should be further appreciated that the first and second electrical connectors 22 and 26 define a twinax configuration between the mounting interface 44 of the first electrical connector and the mounting interface 114 of the second electrical connector 26, whereby the pair of signal contacts 46 and 116 are at least partially surrounded by the ground shields 52 and 122, and further by electrically nonconductive material that encapsulates at least a portion of the signal contacts 46 and 116.

Figure 7B:
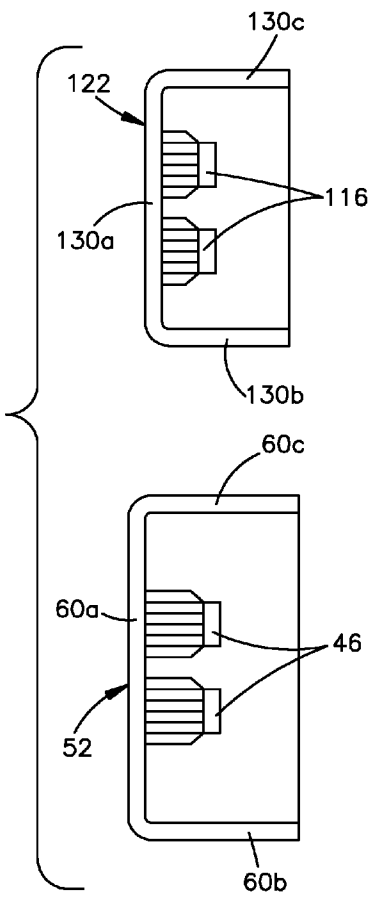
FIGS. 7A-B show side elevation views that illustrate electrical fields generated by various differential signal pairs of the electrical receptacle connector and the electrical header connector illustrated in FIG. 1.
Figure 7A:
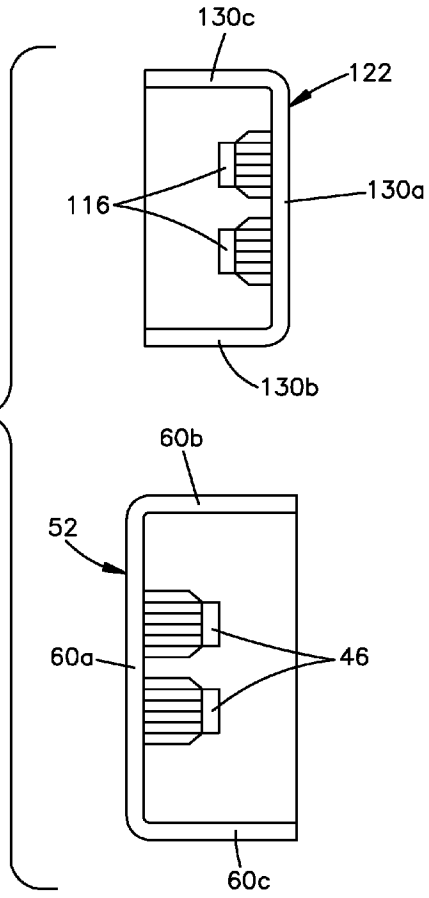

Referring now to FIGS. 7A-B, it should be appreciated that the first wall 60*a* of the electrical ground shield 52 can be disposed at the same side as the first wall 130*a* of the electrical ground shield 122 (FIG. 7B), or the first wall 60*a* of the electrical ground shield 52 can be disposed at an opposite side from the first wall 130*a* of the electrical ground shield 122 (FIG. 7A) without causing any substantial distortion of the electrical fields generated at the electrical signal contacts 46 and 116 during operation. Furthermore, it has been recognized that the electrical field can define an increasingly desirable profile when the opposed broadsides of the electrical signal contacts 46, 116 are as planar and close to parallel to each other as possible, and as close to parallel to the inner surface of the corresponding first wall 60*a*, 130*a* as possible. Thus, while it is known to stamp the electrical signal contacts from sheet metal, the stamped signal contacts can have geometric deformities that cause the broadsides to be slightly bowed, and thus slightly nonparallel to each other. Accordingly, the electrical signal contacts 46 and 116 can undergo a subsequent flattening operation after the stamping operation. The subsequent flattening operation can, for instance, be a rolling operation that causes the broadsides to increase planarity compared to after the stamping operation, along with the degree at which the broadsides are parallel to each other. For instance, a first percentage of the broadsides are perfectly parallel to each other after the stamping operation, and a second percentage of the broadsides that is greater than the first percentage are perfectly parallel to each other after the flattening operation. For instance, between 70% and 100% of the broadsides of the electrical signal contacts 46 and 116 can extend perfectly parallel to the other of the broadsides of the electrical signal contacts 46 and 116, and thus extend perfectly parallel to the first wall of the corresponding electrical ground shield.

Thus, a method of fabricating an electrical signal contact, can comprise the steps of 1) stamping a blank so as define the electrical signal contact defining first and second broadsides and first and second edges that extend between the first and second broadsides, wherein a first percentage of one of the first and second broadsides is perfectly parallel to the other of the first and second broadsides, and 2) after the stamping step, flattening the electrical signal contact such that a second percentage of the one of the first and second broadsides is perfectly parallel to the other of the first and second broadsides, the second percentage greater than the first percentage.

In accordance with an example embodiment, both the first and second electrical connectors 22 and 26 support differential signals that travel between the mating ends and the mounting ends of the respective electrical signal contacts at rates of 80 Gigabits/second at 5 to 30 picosecond rise time produce 6% or less asynchronous worst-case multiactive crosstalk. For instance, the differential signals that travel between the mating ends and the mounting ends at rates of 80 Gigabits/second in six differential signal pairs along first, second, and third column centerlines that are closest to a victim pair (the victim pair defined by one of the differential signal pairs), the victim pair produce no more than six percent worst-case, multi-active cross talk on the victim differential signal pair. The differential signals can transfer along the electrical signal contacts at frequencies up to 75 GHz, including approximately 50 GHz and 40 GHz.

Each of the first and second electrical connectors 22 and 26 are capable of transferring differential signals at data transfer rates of one-hundred fifty gigabits per second, including one hundred gigabits per second, such as eighty gigabits per second through the respective electrical connector while producing no more than an acceptable level of cross talk on any of the differential signal pairs, for instance at 5 to 30 picosecond rise time produce 6% or less asynchronous worst-case multiactive crosstalk, and in one example the differential signals that travel between the mating ends and the mounting ends at the data transfer rates in six differential signal pairs along first, second, and third column centerlines that are closest to the victim pair produce no more than six percent worst-case, multi-active cross talk on the victim differential signal pair.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector configured to be mounted onto a substrate, the electrical connector comprising:

a connector housing defining an end that is configured to be mounted to the substrate; a plurality of electrical signal contacts supported by the connector housing; and a plurality of ground shields supported by the connector housing, the ground shields at least partially surround respective ones of the electrical signal contacts, the ground shields defining a body that extends through the connector housing, wherein each body of the plurality of ground shields defines a first wall and a second wall that extends from the first wall and is angularly offset with respect to the first wall, and each of the first wall and the second wall extend through the end of the connector housing so as to be disposed between the end and the substrate when the connector is mounted to the substrate.

2. The electrical connector as recited in claim 1, wherein the connector housing comprises a first housing portion comprising an electrical or magnetic absorbing material.

3. The electrical connector as recited in claim 2, wherein the housing includes at least one second housing portion that comprises a dielectric or electrically insulative material, the at least one second housing portion supported by the first housing portion.

4. The electrical connector as recited in claim 3, the electrical connector defining a mating interface configured to operatively engage a second electrical connector, wherein the at least one second housing portion is disposed at the mating interface.

5. The electrical connector as recited in claim 4, wherein pairs of the electrical signal contacts define differential signal pairs, the electrical connector further comprising a plurality of the second housing portions, and at least ones of the differential signal pairs extend through respective ones of the plurality of the second housing portions.

6. The electrical connector as recited in claim 1, wherein pairs of the electrical signal contacts define differential signal pairs.

7. The electrical connector as recited in claim 1, further comprising a vertical electrical connector.

8. The electrical connector as recited in claim 7, wherein the end is a rear end, and the connector housing further defines a front end spaced from the rear end along a mating direction, and the ground shields extend through the front end and the rear end, such that one end of the ground shields terminates at a location rearward of the rear end and spaced from the rear end in a direction that is opposite the mating direction.

9. The electrical connector as recited in claim 8, further comprising a header connector.

10. The electrical connector as recited in claim 1, further comprising a right-angle electrical connector.

11. The electrical connector as recited in claim 10, further comprising a receptacle connector.

12. The electrical connector as recited in claim 1, wherein the first walls are substantially parallel to a broadside of respective ones of the electrical signal contacts, and the second walls are substantially parallel to a first edge of respective ones of the electrical signal contacts.

13. The electrical connector as recited in claim 12, wherein each of the ground shields further define a third wall that extends from the first wall such that the third wall and the second wall extend from opposed ends of the first wall.

14. The electrical connector of claim 13, wherein the second wall is oriented parallel to the third wall.

15. The electrical connector of claim 14, wherein the third wall is substantially parallel to a second edge of respective ones of the electrical signal contacts.

16. The electrical connector of claim 14, wherein each of the second wall and the third wall is oriented perpendicular to the first wall.

17. The electrical connector of claim 1, wherein the end of the housing connector is a rear end, and the connector housing further defines a front end opposite the rear end along a longitudinal direction, such that each of the ground shields extends forward from the front end along the longitudinal direction.

18. The electrical connector of claim 17, wherein each of the ground shields extends out from the front end a distance that is at least equal to a distance that the electrical signal contacts extend out from the front end along the longitudinal direction.

19. A vertical electrical connector comprising:

a connector housing;

a plurality of electrical signal contacts carried by the connector housing, adjacent pairs of the electrical signal contacts defining a plurality of differential signal pairs that are arranged along respective column centerlines that extend along a column direction and row centerlines that extend along a row direction that is angularly offset with respect to the column direction; and a plurality of ground shields carried by the connector housing such that the ground shields are disposed adjacent more than two sides of respective ones of the differential signal pairs, wherein at least one ground shield of the plurality of ground shields comprises a wall having an aperture defined thereon;

wherein all differential signal pairs that are disposed along a respective column centerline are spaced along the column direction with respect to all of the pairs that extend along an adjacent column centerline, and all electrical signal contacts that are disposed along a respective row centerline are spaced along the row direction with respect to all of the electrical signal contacts on an adjacent row centerline.

20. The vertical electrical connector as recited in claim 19, wherein the row direction is perpendicular to the column direction.

21. The vertical electrical connector as recited in claim 19, wherein the ground shields are electrically isolated from each other in the electrical connector.

22. The vertical electrical connector as recited in claim 21, wherein the ground shields terminate at two pairs of mounting ends, the mounting ends of each of the two pairs spaced along respective first and second directions that are substantially parallel to each other.

23. The vertical electrical connector as recited in claim 22, wherein the mounting ends comprise press-fit tails.

24. The electrical connector of claim 19, wherein the ground shields each define a first wall, and second and third walls that each define a distal end and a proximal end opposite the distal end, the proximal ends extending from opposed ends of the first wall such that the electrical signal contacts of a respective one of the differential signal pairs are disposed between the first wall and a line that connects the distal ends of the second and third walls.

25. The electrical connector as recited in claim 24, wherein the line that connects the distal end of the second wall to the distal end of the third wall is parallel to the first wall.

26. The electrical connector of claim 19, wherein the aperture comprises a slot.

27. An electrical connector configured to mount to a substrate, the electrical connector comprising:

a connector housing defining an end that is configured to be mounted to the substrate;

a differential pair of electrical signal contacts supported by the connector housing; and a ground shield supported by the connector housing and at least partially surrounding the differential signal pair, wherein the differential pair of electrical signal contacts defines mounting ends that are aligned with each another in a first direction, and the ground shield defines a first pair of ground mounting ends and a second pair of ground mounting ends that is spaced from the first pair along the first direction, the ground mounting ends in the first pair aligned with each other in a second direction that is angularly offset with respect to the first direction, and the ground mounting ends in the second pair aligned with each other in the second direction.

28. The electrical connector as recited in claim 27, wherein the second direction is substantially perpendicular to the first direction.

29. The electrical connector as recited in claim 27, wherein the electrical connector is a vertical electrical connector.

30. The electrical connector as recited in claim 27, wherein the electrical connector is a right-angle electrical connector.

31. The electrical connector as recited in claim 27, wherein the mounting ends of the electrical signal contacts and the first and second pairs of ground mounting ends of the ground shield are arranged substantially in a U-shape, and the ground shield defines a substantial U-shape.

* * * * *